US009064282B1

(12) United States Patent
Carpenter et al.

(10) Patent No.: US 9,064,282 B1
(45) Date of Patent: Jun. 23, 2015

(54) LIVE AUCTIONING SYSTEM AND METHODS

(75) Inventors: Brian Carpenter, Frisco, TX (US); Jim Halperin, Dallas, TX (US); Matt Jackson, Frisco, TX (US); Paul Minshull, Dallas, TX (US); Brian Shipman, Waxahachie, TX (US); Ryan Sokol, Frisco, TX (US); Michael Weems, Arlington, TX (US)

(73) Assignee: HERITAGE CAPITAL CORP., Dallas, TX (US)

( * ) Notice: Subject to any disclaimer, the term of this patent is extended or adjusted under 35 U.S.C. 154(b) by 495 days.

(21) Appl. No.: 12/784,575

(22) Filed: May 21, 2010

Related U.S. Application Data

(60) Provisional application No. 61/180,172, filed on May 21, 2009.

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
CPC ..... G06Q 30/08
USPC ..... 705/26.1, 26.2, 26.25, 26.3, 26.35, 705/26.4, 26.41–26.44, 26.5, 26.61–26.64, 705/26.7, 26.8, 26.81, 26.82, 26.9, 27.1, 705/27.2
See application file for complete search history.

(56) References Cited

U.S. PATENT DOCUMENTS 6,243,691 B1 * 6/2001 Fisher et al. ..... 705/37
6,609,112 B1 * 8/2003 Boarman et al. ..... 705/37
7,069,243 B2 * 6/2006 Dinwoodie ..... 705/37
7,139,844 B2 * 11/2006 Smith et al. ..... 709/250
7,197,476 B2 * 3/2007 Le et al. ..... 705/26.3
7,424,623 B2 * 9/2008 Du et al. ..... 713/300
7,555,767 B2 * 6/2009 Takagi et al. ..... 725/23
7,624,065 B2 * 11/2009 Schoen et al. ..... 705/37

(Continued)

FOREIGN PATENT DOCUMENTS

KR 1020010109695 A * 12/2001 ..... G06F 17/60

OTHER PUBLICATIONS

Edieal J. Pinker et al. "Managing Online Auctions: Current Business and Research Issues", Management Science © 2003 Informs vol. 49, No. 11, Nov. 2003, pp. 1457-1484.*

(Continued)

*Primary Examiner* — Naeem Haq
(74) *Attorney, Agent, or Firm* — Jacobson Holman, PLLC.

(57) ABSTRACT

An auctioning method is conducted using an interactive auction host system. The method includes providing access for auction participants to a live auction for one or more auctioned lots of products or services that is conducted and overseen by an auction administrator at an auction host location. At least some of the access to the live auction is provided to remote auction participants through an auction host system of the auction host system. Data is transmitted substantially in real time from the auction host system, which may include auction-related data and at least one of video and audio feeds of the live auction through a network to one or more remote auction participants located at a remote participant interface. Information provided from the remote auction participants through the remote participant interface is provided and received by auction host system. At least one of various other actions are performed.

25 Claims, 17 Drawing Sheets

(56) References Cited

U.S. PATENT DOCUMENTS

| | | | | |
|---|---|---|---|---|
| 7,664,677 | B2 * | 2/2010 | Rabenold et al. | 705/26.3 |
| 7,693,747 | B2 | 4/2010 | Bryson et al. | |
| 7,711,608 | B2 | 5/2010 | Asami | |
| 7,801,768 | B2 * | 9/2010 | Jain et al. | 705/26.3 |
| 8,157,642 | B2 * | 4/2012 | Paulsen | 463/25 |
| 2001/0034697 | A1 * | 10/2001 | Kaen | 705/37 |
| 2002/0087456 | A1 * | 7/2002 | Abeshouse et al. | 705/37 |
| 2006/0059062 | A1 * | 3/2006 | Wood et al. | 705/35 |
| 2008/0201751 | A1 * | 8/2008 | Ahmed et al. | 725/109 |

OTHER PUBLICATIONS

Inlet Technologies, Heritage Picks Inlet to Stream Live Auction House Excitement, Sep. 23, 2008, pp. 1-2.

* cited by examiner

© 2010 Heritage Auctions, Inc.

186

188

Compare Items

| | | |
|---|---|---|
| Image | | |
| Lot Name | | |
| Sale # | 7009 | 7009 |
| Session # | - | - |
| Lot # | 91219 | 91220 |
| Category | Signature - Vintage Comics & Comic Art | Signature - Vintage Comics & Comic Art |
| Estimate | $1000.00 | $500.00 |
| Current Bid | $850.00 | $280.00 |
| Next Bid | $500 | $300 |
| Status | No Reserve | No Reserve |
| Details | | |

© 2010 Heritage Auctions, Inc.

FIG. 13

LIVE AUCTIONING SYSTEM AND METHODS

CROSS-REFERENCE TO RELATED APPLICATIONS

This application claims the benefit of U.S. Provisional Application No. 61/180,172, filed May 21, 2009, which is incorporated herein by reference in its entirety.

COPYRIGHT PROTECTION

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BRIEF DESCRIPTION OF THE DRAWINGS

For a more complete understanding of the present invention, and the advantages thereof, reference is now made to the following descriptions taken in conjunction with the accompanying figures, in which:

FIG. 13 is an example of a compared lots window of a remote participant showing compared lots;

DETAILED DESCRIPTION

Figure 1:
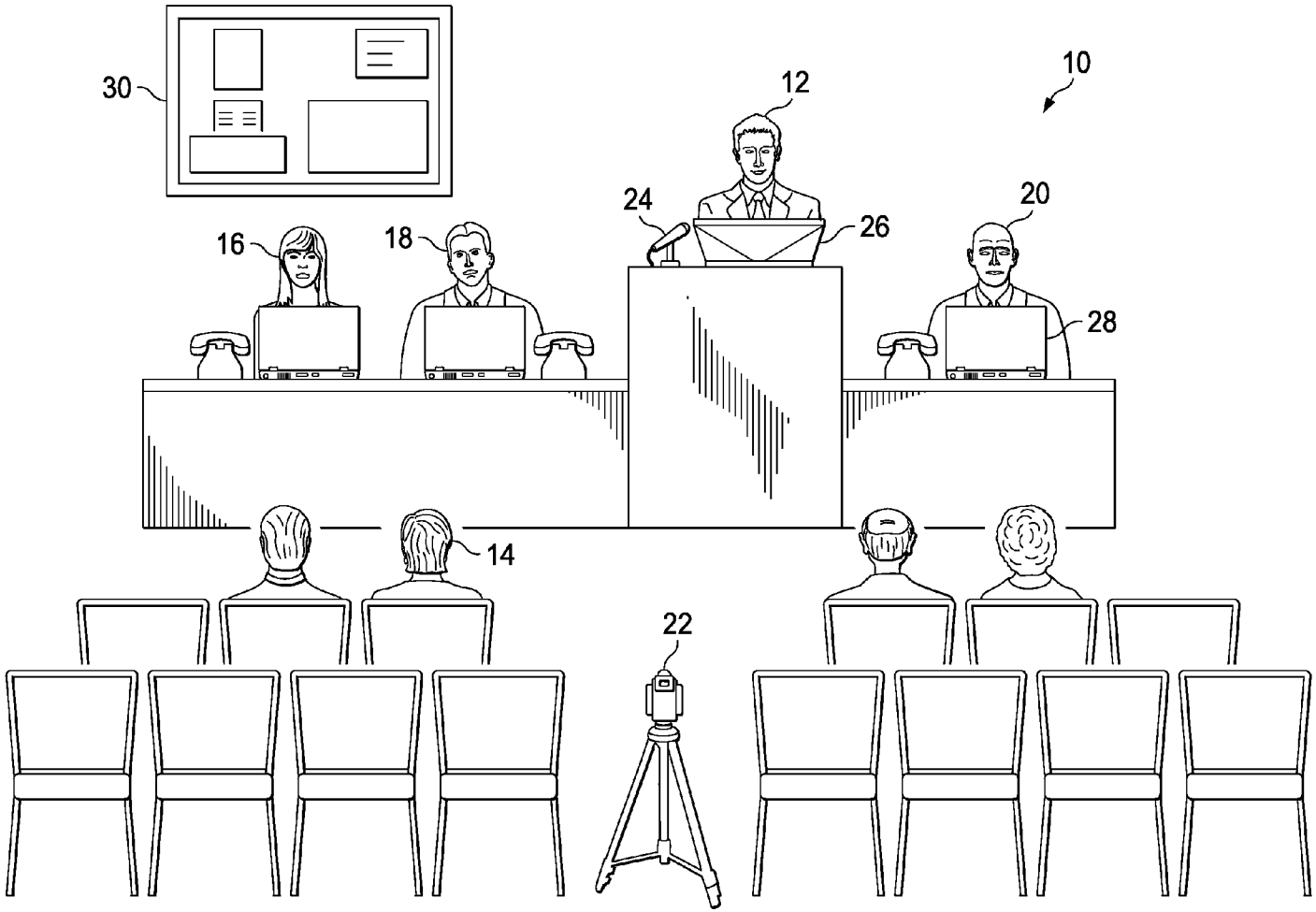
FIG. 1 is a schematic representation of an auction room for conducting a live auction with an auction host system in accordance with the invention.

Referring to FIG. 1, an auction room or venue 10 is shown where a physical live auction is conducted by an auction host for the auctioning of various goods and/or services. Such goods and services are auctioned in lots wherein each lot, which may contain one or more goods and/or services, is offered for bidding by the auction participants. The auctioned lots may be offered in auction sessions wherein several lots, which may be related or unrelated to one another, are auctioned to the auction participants. Non-limiting examples of items that may be auctioned may include works of art, sports collectables, comic books, historic artifacts, stamps, coins and currency, rare books and manuscripts, natural history specimens, jewelry, time pieces, photographs, memorabilia of various kinds (e.g. sports, music, entertainment, political, Americana, popular culture, etc.), automobiles, firearms and weaponry, vacation and resort packages, etc.

As shown in FIG. 1, an auctioneer or overseer 12 facilitates the conducting of the auction, including verbally describing the items or lots being auctioned and providing verbal or audible information and instructions related to the auction. The auctioneer 12 may announce an opening bid, the current bid amount and a proposed next bid amount. The auctioneer 12 may also acknowledge the bids of "floor" auction participants 14 that are physically present in the auction room or auction venue 10, with the bids of such floor participants 14 being referred to as "floor bids." One or more auction administrators, such as at 16, 18 and 20, may also be present in the auction room 10 to facilitate conducting and administration of the auction. The auctioneer or overseer may also constitute an auction administrator.

Provided in the auction room venue 10 are one or more video recording devices or cameras 22 and one or more audio recording devices, such as the microphone 24, which may located on or near the auctioneer, such as at the auctioneer's podium or station. The video recording device may also contain its own audio recording device that is integrated with the video device 22. The video and audio recording devices 22, 24 record images and audio within the auction room or venue. These may be configured to capture images and sound from the auctioneer 12 and the auctioneer's surroundings. Recordings may be made on multiple systems for confirmation and research purposes and each recorded session may be stored and archived for later use or retrieval.

The auctioneer 12 may be provided with a device 26, such as a personal computer or other computing device, with a monitor or display, for displaying an auctioneer display, which is described in more detail later on, with information regarding the auction. It should be noted that when a computer, server or computing device or system is referred to herein, it should be understood that such devices or systems may be provided with processers, memory, hard drives, data storage hardware, software, input devices (e.g. keyboard, keypad, mouse, touch screen, touch pad, stylus, etc.), displays, etc., as necessary for the operation and functioning of such devices or systems as described herein. Similarly, one or more of the auction administrators 16, 18, 20 may each be provided with a device 28, such as personal computer or computing system, with a monitor or display, for displaying an auction administrator display, which may be the same or different for each administrator 16, 18, 20. One or more larger display devices 30 may also be provided for displaying an auction room display, which is described in more detail later on. The display device 30 may be readily visible to the occupants of the auction room or venue 10. The display device 30 may be coupled to a computer or other device (not shown) that provides images to the display device 30. This may include coupling of the display device 30 to one or more of the devices 28 of the administrators 16, 18, 20.

Other equipment and devices necessary for conducting the auction within the auction room 10 may also be provided. This may include one or more phones or other communication equipment for receiving phone bids, email bids, etc.

Figure 2:
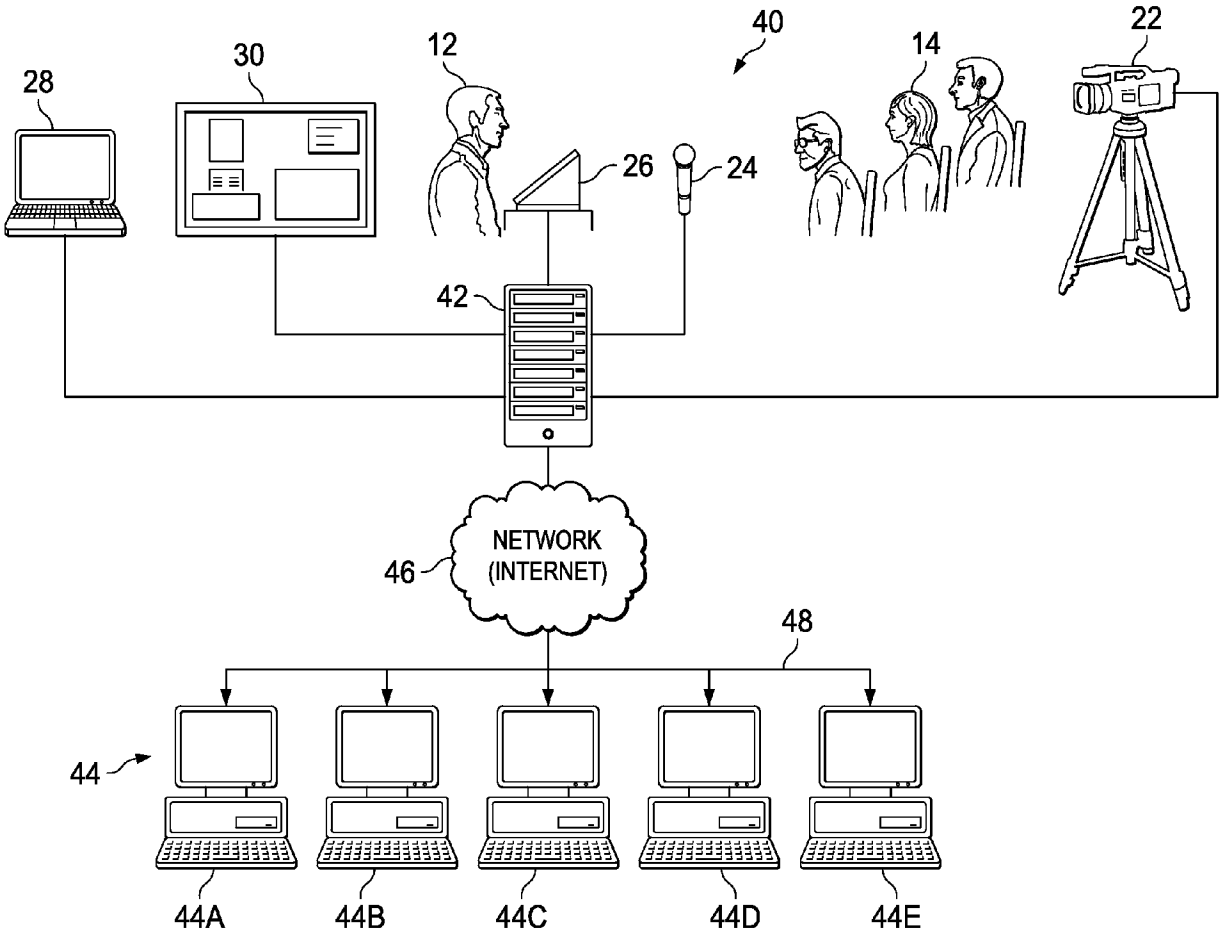
FIG. 2 is a schematic representation of an auction host system configured in accordance with the invention.

Referring to FIG. 2, an auction host system 40 is shown that integrates the auction conducted in the auction room 10 with remote auction participants. The system 40 may include one or more interconnected or networked computer or server systems 42 of or utilized by the auction host. The computer or server system 42 may be dedicated computer or server systems or be part of a computer or server system utilized for other purposes. As used herein the expression "computer" or "server" with respect to the auction host system may be used interchangeably, as the server may constitute a computer. Additionally, as used herein, the expression "auction host system" or similar expressions are meant to include the overall auction host system, which may include any computers, servers, communication links, software and other elements of the system that are required to provide the necessary function and operation of the auction process as it is described herein. The servers 42 are in communication to remote auction participants designated generally at 44 through a communication network 46, such as wide area network, the Internet, etc., which may be an outside or non-auction-host network. In most embodiments, the network 46 constitutes the Internet. The network 46 or portions thereof may be wireless and/or non-wireless. The remote auction participants each have a user interface 44A, 44B, 44C, 44D, 44E, which may be in the form of a personal computer system or other device, such as a desktop, all-in-one, laptop or notebook computer, a tablet computer, a mobile communication device, a smart phone, a PDA, or other device, that communicates with the server 42 and is capable of performing the functions described herein. Such systems or devices 44 may include a display, a communication link (wireless or non-wireless) 48 for communicating with the network 46, a speaker or sound system, an input device (e.g. keyboard, keypad, mouse, touch screen, touch pad, stylus, etc.) for inputting data, information or instructions, memory, processor, operating system or software, a browser, etc.

As can be seen in FIG. 2, the video and audio devices 22, 24 are in communication with the server system 42 for providing video and audio feeds from the auction room 10 to the server that are transmitted through the network 46 to the remote auction participants 44. Additionally, the auctioneer and auction administrator devices 26, 28 are also in communication with the server 42 and may transmit and receive information or data to and from the server 42. In certain embodiments, the auction devices 26, 28 may be coupled directly to the server 42, such as through local area network (LAN), or through a wider network, such as a wide area network or even the Internet, and may be in communication through the network 46. All or some of the auction devices 26, 28 and other components of the auction host system may be networked or linked together and/or to the server system 42 through a virtual private network (VPN) that may employ encryption (e.g. IPSec VPN-AES 256 encryption, etc.) to prevent unauthorized access.

The display 30, which may be associated with a computer or other device, is also coupled to or in communication with the server 42. The display 30 may be coupled directly to the server 42 or through one of the auction devices 26, 28. The display 30 may also be a duplicate all or a portion of one of the displays of the auction devices 26, 28.

As part of the auction host system 40, auction-related information is provided from the auction room 10 to the remote auction participants 44 substantially in real time. As used herein, the expression "substantially in real time" or similar expressions is meant to include substantially instantaneous or with such low latency or ultra-low latency that participation in the live auction by the remote auction participant is not significantly impaired or affected. Such low or ultra-low latency may be from about 6, 5, 4, 3, 2, 1 or 0.5 seconds or less. Typically, the video stream is provided to the remote auction participant with ultra-low latency of about 2 seconds or less. Transmission of non-video data is typically much faster than video streaming so that there is typically even less delay with respect to the transmission of non-video data information.

The low-latency or ultra-low latency may be accomplished through the use of specific settings in various systems of the auction host system 40 to remove many of the typical sources for latency in live streaming of video and audio. The systems may include the use of live video and audio streaming application products, such as those available as the SPINNAKER™ live streaming products, available from Inlet Technologies, Raleigh, N.C.

Figure 3:
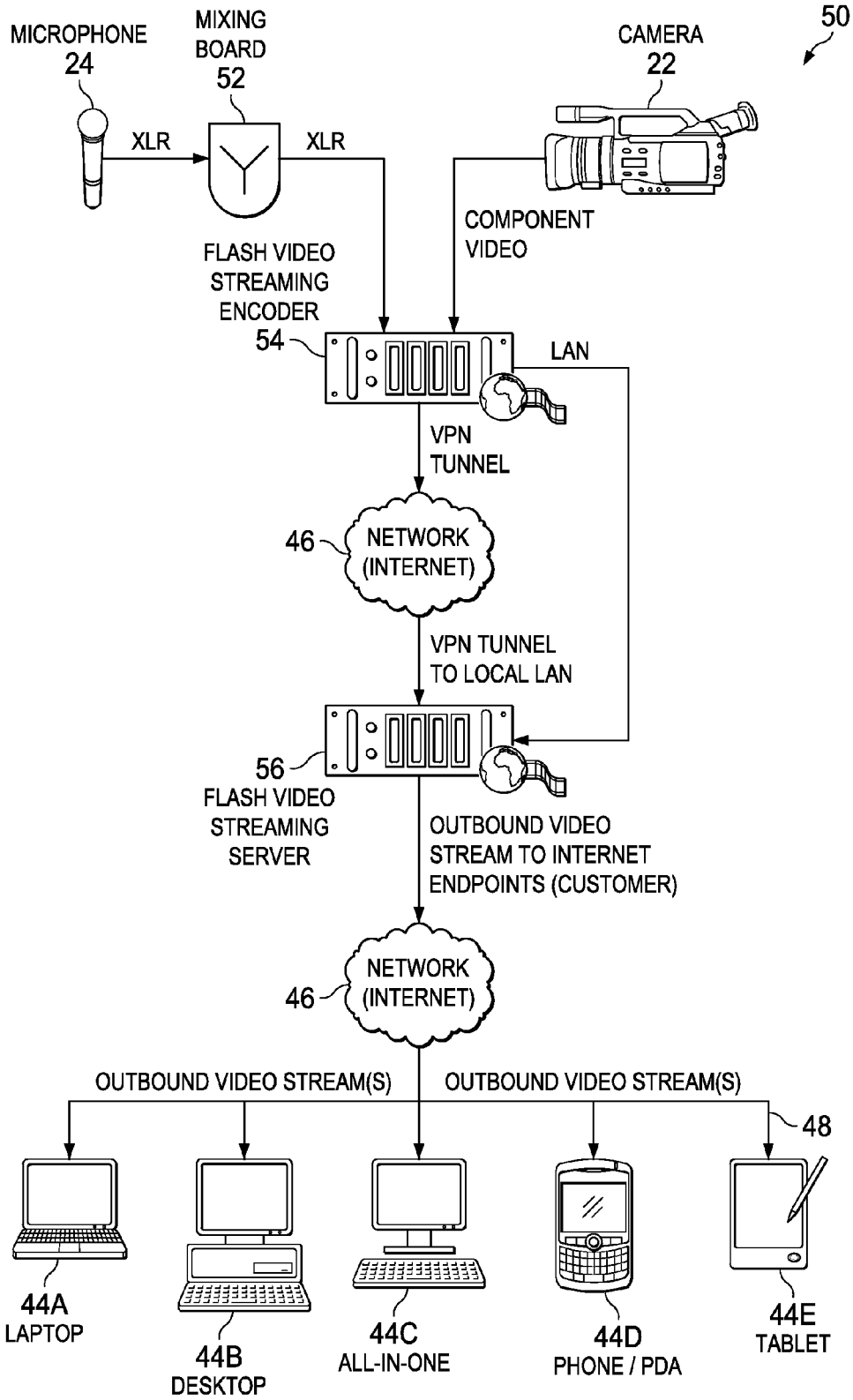
FIG. 3 is a schematic representation of a streaming video and audio feed system of the auction host system.

Referring to FIG. 3, a video and audio streaming system 50 is shown. The audio signal from microphone 24 may be communicated (e.g. through XLR cable) to a sound mixing board 52 for controlling the audio from microphones 24. This along with the video feed from camera 22, which may both be analog and/or digital, may be fed to a streaming video encoder 54, such as a Flash video streaming encoder, provided on a computer, server or other system, which may include the server system 42. The video encoder may digitize, if necessary, the video and audio streams. The video encoder may have settings that minimize stream buffering. In certain embodiments, such as for the Flash video encoder, the settings may be based on TrueMotion VP6 Codec and H.296/MPEG-4 Advanced Video Coding standards. By utilizing a combination of key frame intervals, low bit rate for audio and video and low buffering levels, the audio and video feeds can be encoded substantially instantly. The output of the streaming video encoder 54 is then fed to a video streaming server 56, which may also form a part of the computer or server system 42. As shown, the output from the encoder 54 may be transmitted through a network, such as the Internet network 46, to the video streaming server 56 or directly to the server 56 through a LAN or other connection. In certain embodiments, the video and audio may processed and transmitted separately so that if there is a delay in the transmission of the video feed, the audio feed, which may be transmitted at a faster rate, is still received in substantial real time. Transmission of the video encoder 54 feed, or any separate audio feed, through the Internet network 46 to the video streaming server 56 may be used in situations where a live auction is being conducted from a location that is remote from the auction host computer or server system. The transmitted and received feeds or signals by the auction host through the network 46 may be private or otherwise secured and encrypted.

The computer or server system 42 (FIG. 2) may be configured to prevent or minimize buffering and to receive the customized compression settings of the encoded video stream from the encoder 54. This may include adjusting the buffering settings from seconds to sub-second or millisecond buffering. The output from the video streaming server 42 may be transmitted as video stream from a video player (e.g. Adobe Flash video player) that may be embedded in the auction host application or website to the remote auction participants 44 through the network 46. The substantially real time streaming may be provided even when the video encoder is transmitted through a remote network and not through a local network, such as when the encoder 54 transmits the encoded signal to the server 56 through the Internet.

To further facilitate substantially real time streaming and data, a plug-in or application provided with the auction host computer or server system may be used to detect the remote auction participant's interface 44 configuration and adjust the transmission based upon each configuration. This may detect that bandwidth that is available on the remote participant's system. The plug-in or application then determines the best stream or data transmission suited for the remote participant's system and the available bandwidth for the remote participant's system. Additionally a plug-in or application may be provided with the auction host system that detects the estimated buffering on the remote participant's system and that resets the connection if the buffer is too long. Examples of such commercially available plug-ins include those available from Flowplayer Ltd. Additionally, video/audio streams may be periodically refreshed for all remote participants regardless of buffer settings in order to introduce the lowest possible time for video stream delivery.

In certain instances, where the remote participant is aware or the auction host becomes aware that the remote participant does not have sufficient bandwidth to adequately receive the video feed, the remote participant or auction host can turn off the video stream and stream only the audio portion so that they have an improved experience.

In order to test and ensure that the video and audio are being properly transmitted and received by the remote auction participants, a test system of the auction host system may be used that replicates the remote user's experience for audio and video that is transmitted from the auction host system. This may be conducted prior to a start of an auction or auction session. If any problems are detected as a result of the test, these may be resolved or other actions may be taken, such as only streaming the audio portion, etc., prior to the opening of the auction so that the remote user is not inconvenienced.

Delivery of information by the auction host system to the remote auction participant may be provided with no extra software required by the remote auction participant other than the normal web browser or other applications or software that may be available on the remote participant's interface and that are typically provided with such devices. All of the applications and script may be provided on the auction host's computer or server system and only one HTTP or other connection may be needed to maintain real-time auction updates from the auction host computer or server system. In certain embodiments, this may be facilitated by the use of memcache queries, wherein server-side script is able to detect changes in the live auction state, such as auction states and bidding, and transmit them to the remote participant's interface immediately. The remote participant may be able to query the memcache hundreds of times per second with little delay.

Figure 4:
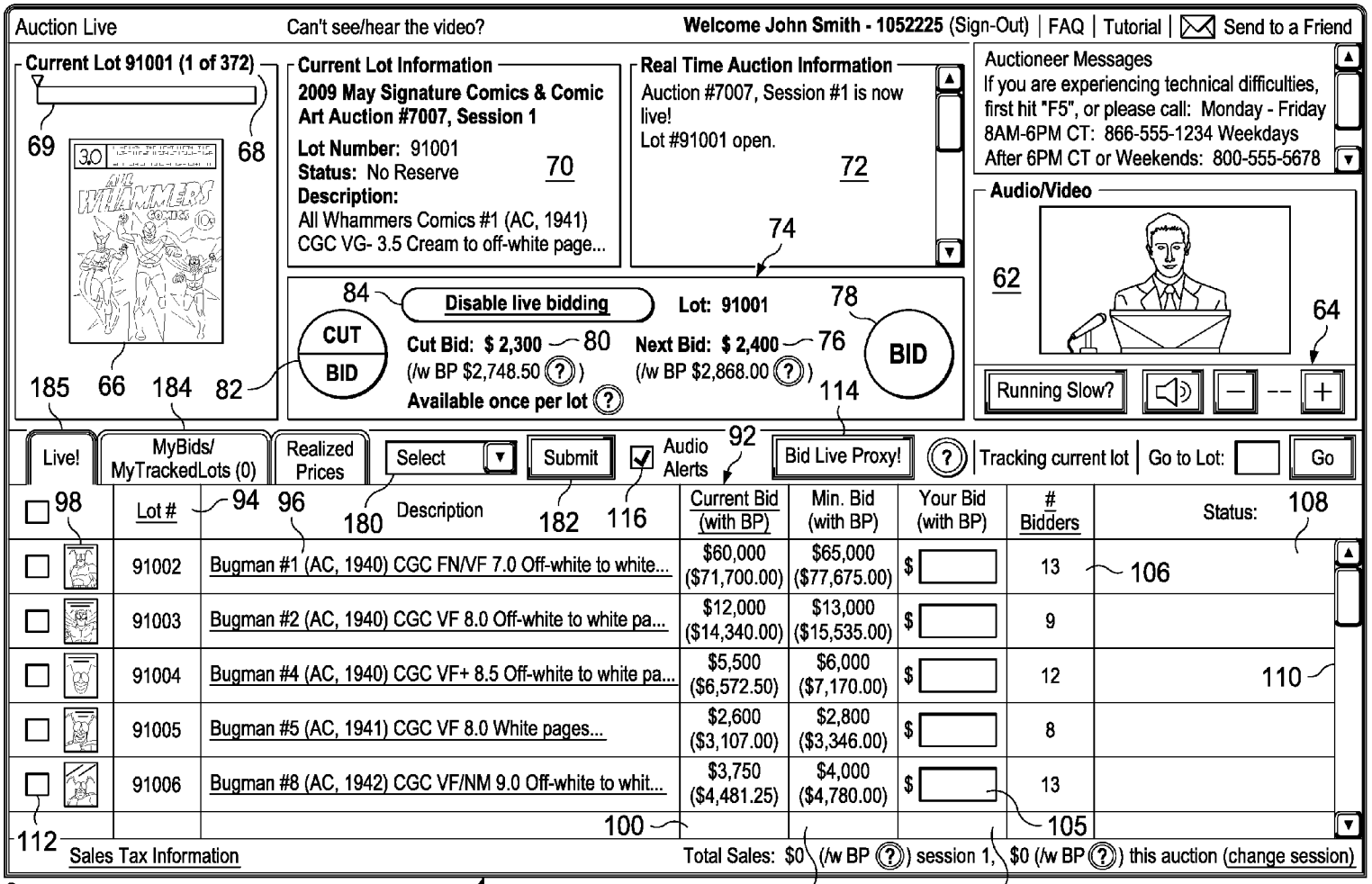
FIG. 4 is an example of a screen display for a live auction that may be provided on a remote auction participant interface.

The present live auction system provides many different features that facilitate the participation and interaction of remote auction participants with the live auction being conducted at the auction host location or venue 10. FIG. 4 shows an example of a screen display 60 that may be provided on the remote auction participant's interface device 44. It should be noted that the screen display may be varied and configured for the system type used by the remote user. Thus, those users employing laptop or desktop computers, which may have a much larger display or monitor, may have a different screen display configuration. Those remote participants utilizing a handheld device, such as a mobile phone, smart phone or PDA, may have a different screen display that is configured for a smaller display and which may include less information.

When the remote auction participant accesses the auction host system, the remote user may be initially provided with a log in or registration screen, where the user enters any user information required by the auction host to participate in the auction or use the auction system and to provide identification information to the auction host. Once accessed, the user may navigate or be provided with a live auction screen display, such as the screen 60 shown in FIG. 4. If several live auctions are being conducted simultaneously, a user may select or navigate to the particular live auction they wish to participate in.

In at least a portion of the screen 60, a streaming video field 62 may be provided by the auction system that provides a video image of the auction room 10, which may show a live video image of the auctioneer or overseer or the auction room or venue during the conducting of the auction. Other video images of the auction room may also be included, such as lot items for bid that may be present in the auction room. Video images of objects that are not included in the auction room may also be included in the streaming video. In certain embodiments, the video images may be pre-recorded images that are streamed to the remote participant's interface. These may include images of lot items being offered for bidding or other objects. Video images of other features, information or advertising may also be provided. Advertising for upcoming auctions or events and offered products or services may be provided in the video field 62. In many or most applications, however, the video field 62 is used for providing video image of the auction room to facilitate providing the remote auction participant with an approximation of the experience of actually being present in the auction room or venue itself.

As can be seen, the video field 62 may be provided with video/audio controls 64 for controlling the video and audio levels, such enlarging or minimizing the video field, muting or increasing or decreasing the volume.

A variety of other information may also be provided on the auction screen 60. A lot item image display 66 may be provided on the screen 60. This may be a representation or an actual image of the lot item or one or more items of a particular lot that is currently being auctioned. Lot hierarchy and progress information 68 that identifies the current lot being auctioned and its relative position among total lots being auctioned in a session (e.g. lot 2 out of 100 lots) and a progress bar 69 or other indicator may also be provided on the screen. Current detailed lot information 70 may also be provided in a portion of the screen 60. This may include a live auction session description, a session identifier (e.g. session no.), a lot number or identifier, reserve or other status of the lot item and a lot item description.

A live auction information field 72 may also be provided on the screen. This and other information in the screen may be continuously updated in substantially real time so that the remote participant is provided with up to date information regarding the auction. The live auction information may include one or more session identifiers and their status (e.g. open or live, closed, upcoming, etc.), the current lot status (e.g. open, closing, closed, auction paused, auctioned resumed, reopened, etc.) and time stamps of the status events, updated bid information that includes each successive bid amount, the bid type (e.g. floor, Internet, phone, mail, etc.), the final winning bid and other information regarding the current lot and its status.

A live bidding field 74 may also be provided on the screen display 60. When placing bids, both live and proxy bids, the bidding is typically conducted in preselected increments. For example, the preselected increments may be $50, $100, $250, $500, $1000 increments, etc. A next bid amount 76 that the participant may place is provided in the bidding field 74. The next bid amount is based upon the current bid plus the preselected increment amount required to outbid the current live bid and is continuously updated in substantial real time as the bidding is carried out. The next bid amount may also be displayed with the total bid amount plus any additional costs or expenses that may be incurred by or charged to the remote participant (e.g. buyer's premium (bp), shipping, taxes, etc.). By clicking or activating a bid command button 78 or other instruction, the next bid amount can be quickly placed by the remote participant. Other methods for executing bids may also be provided in the remote participant interface. The bid request or instruction is then transmitted to the auction host through the auction host system. If accepted, the placed bid may be displayed in the live auction display field 72 where it is displayed to other remote auction participants, as well, and on the displays 26, 28 and 30 of the auction host system. If after clicking the bid button 78, the participant is the highest bidder, the bid button 78 may be deactivated so that another bid may not be placed. A message or indicator may be provided indicating the button 78 is deactivated. This may include the button 78 changing in appearance, such as a different color (e.g. gray) or a message near the button or on the button surface, indicating it is deactivated. If after executing a bid, the participant is not the highest bidder, the bid button 78 may remain active and a similar indicator or no change may occur to indicate the button 78 remains active. The information bidding field 74 is updated as well.

Also provided in the live bidding field 74 is a cut bid amount 80. Bidders are typically only able to bid in the preselected bid increments. In certain embodiments, however, the auction host may allow the auction participants to bid in an increment that is less than the full preselected bid increment allowed for normal bidding. The cut bids may be provided to the remote auction participants, as well as the floor, phone and other auction participants. This allows the auction participants to place a reduced bid or cut bid in an amount that is less than a preselected incremental full bid amount assigned for each auctioned lot. The cut bid may be ¼, ½ or ¾ of that of the full bid increment, although the cut bid may be assigned any value less than the full bid increment and greater than zero. In many embodiments, the cut bid increment is one-half of the full bid increment. A limited number of cut bids may be allowed for one or more or all of the lots for some or all of the auction participants. In certain embodiments, a limited number of cut bids may be allotted to each participant for each session, which may be used with any lot within the session and/or a limited number of cut bids may be used with each lot. For example, 5 cut bids may be allotted for each participant per session, with one cut bid being usable per lot within the session. Alternatively, all 5 or fewer cut bids allotted for the session may be used for any particular lot within the session. In certain embodiments, however, each participant is allowed only one cut bid per lot for all lots within the session. The number of cut bids and how they are allotted or used can be varied and controlled by the auction host.

Figure 5:
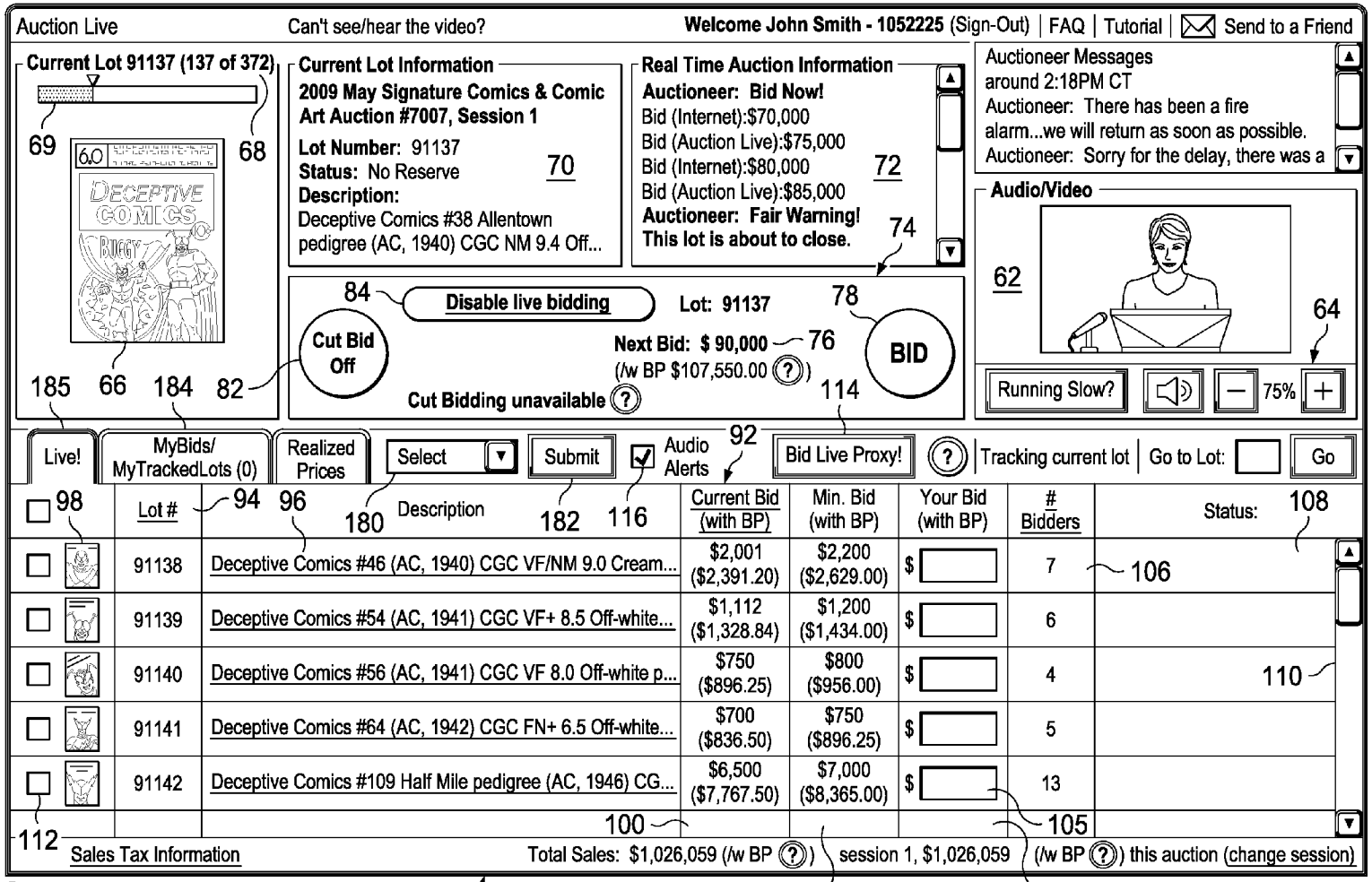
FIG. 5 is an example of a screen display where a cut bid option has been deactivated.

The cut bid amounts received by the auction host system are continuously updated instantaneously or in substantial real time as the bidding is carried out. To execute a cut bid, the remote auction participant may click or activate a cut bid command button 82 to place the cut bid in the cut bid amount 80. The auction participants may be prohibited from placing further cut bids once they have placed the preselected limited number of cut bids. Each remote auction participant's placed cut bids are stored on the auction host system, such as in a memory register of the host computer system or server so that they may be tracked. In certain embodiments, a javascript may be used on the remote participant or client side that checks a local "canCutBid" flag. Server-side validation may also be used for the client to ensure that a browser reloads that will disable the cut bid command 82. Additionally, a server side validation may be performed wherein the "canCutBid" register in memory is checked for each remote participant on the server before any cut bid can be accepted. Other methods of disabling the cut bid command 82 may also be implemented so that it can no longer be used once the limited number of cut bids have been placed. In addition to disabling the cut bid command 82, a message may also be provided on the screen 60 or within the bidding field 74 that also indicates that the user no longer has any cut bids remaining. The cut bid command 82 may also change in appearance to indicate it is deactivated. This is shown in FIG. 5. The cut bid command 82 may be reactivated for the next lot or session, if this is allowed by the host. Additionally, as in the case of the bid button 78, the cut bid button may remain active if the cut bid is not the next highest bid. If so, the cut bid command 82 may remain active until the placed cut bid is accepted as a current high bid.

Figure 6:
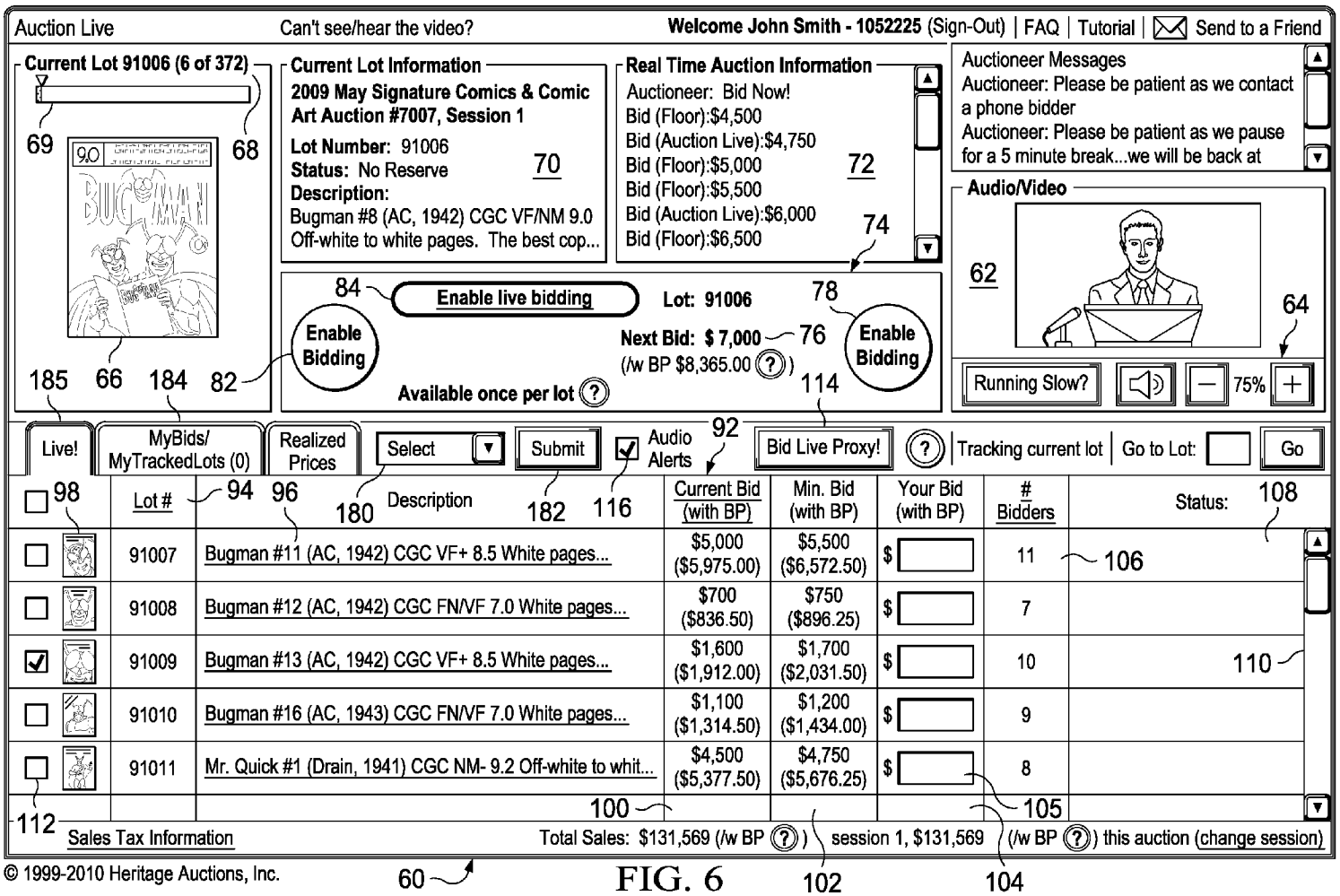
FIG. 6 is an example of a screen display where all bidding options have been disabled.

Both bid and cut bid commands 78, 82 may also be disabled when bidding during the live auction is halted so that no bids may be placed during these periods. Additionally, a command button 84 may also be provided in the bidding field 74 to facilitate disablement and/or enablement of live bidding. When disabled, clicking or activating any of the command buttons 78, 82, 84, as shown in FIG. 6, may reactivate live bidding.

When the remote auction participant initially launches an auction or live auction session, a test bid operation may be initiated by the auction host system. This may be test bid operation that may be initiated when a remote auction participant 44 (FIG. 2) initially accesses information through the network 46 provided from the auction host computer or server system 42. The test bid mimics a bid request that is transmitted to the auction host server 42 over the network 46 to evaluate whether information from the remote auction participant interface 44 is being properly received by the auction host server 42 through the network 46. As an example, this may be conducted through an ajax call that sends a test bid to the server that closely simulates the actual bid. A separate memory register on the server may be provided that is identical or similar to that used for the actual bidding memory register. Server side code may be used to verify that a bid was written to the server in memory. The remote auction participant may be provided at the remote participant interface 44 with an indication that the test bid succeeded or failed and/or that the remote participant should check their firewall, network configuration or other systems.

Figure 7:
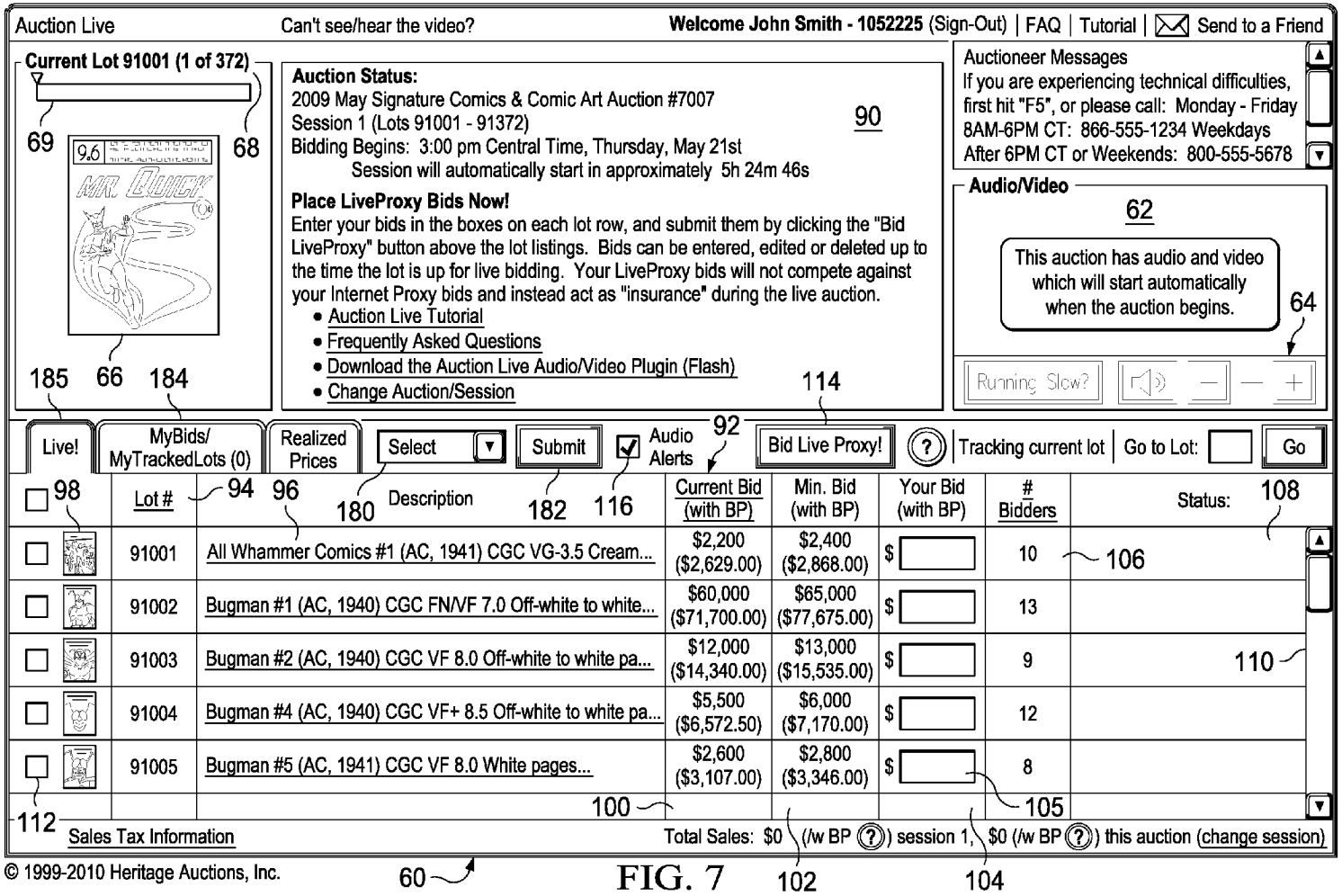
FIG. 7 is an example of a screen display before the opening of a live auction where proxy bidding may be conducted for various lots.

Prior to the commencement of a live auction session or during a live auction session but before the live auctioning of a particular lot, proxy bidding may be conducted for the different lots to be auctioned during the live auction. FIG. 7 shows the screen display 60 prior to the commencement of a live auction session. As can be seen an information field 90 may be provided that indicates information regarding an upcoming auction session. This may include an auction session description, a session identifier (e.g. session no.), lot identifiers within the session, the date and time the auction session is scheduled to open, a countdown clock to the scheduled session opening and an invitation, instructions or other information to facilitate proxy bidding.

To facilitate proxy bidding, a lot listing field or section 92 is provided on the interface screen 60. The lot listing field 92 may include various fields or sections for the different lots of a particular auction. Included in the listing field 92 may be a lot identifier field 94, a lot description 96, a lot image field 98, a current bid field 100, a minimum bid field 102, a participant bid field 104 with a bid entry field 105 for entering a proxy bid amount for a particular lot, number of bidders field 106, status field 108, a scroll bar or navigation tool 110 for navigating through the different listed lots and a selection box field 112 with a selection box for each lot that may be selected for different purposes. Identifiers for each field may be provided in the section 92.

Prior to a live auction session for a group of lots of an auction, auction participants may be allowed to bid on the lot items. This may be several days or weeks in advance of the scheduled live auction. Such bids may be referred to as "proxy bids" or "prebids." To place a proxy bid or prebid, an auction participant enters a maximum bid amount in the bid entry field 105 for the particular lot they wish to bid on. The bidder may then actuate a bid execution command button 114 that transmits the bid request to the auction host system. Other proxy bidders may also place their maximum bids for the same lot item as well. The highest current proxy bid amount for each lot is listed in the current bid amount field 100. Therefore, the minimum bid amount the proxy participant may enter is listed in the minimum bid field 102. The auction host may only allow proxy bids to be placed in preselected bid increments for each lot. Therefore, each bid may be required to be placed in a preselected bid increment above the current bid amount, just as in the live auction, as previously described. If the proxy bidder is the winning bidder a message or other indication may be provided to indicate this, such as in the status field 108. If the proxy bidder is outbid after entering their bid, a message or indication may also be provided to indicate that they have been outbid.

In certain instances, the proxy participant may actually enter a maximum bid that is several bid increments above the minimum bid amount listed. If so, and no higher bids have been received by other bidders, the proxy participant's bid will only be entered at the minimum bid amount or in the necessary number of bid increments up to the maximum bid amount to be the current highest bidder. If other bidders enter bids above the current bid, the auction system will be automatically updated adding the lowest necessary number of bid increments up to the maximum bid amount so that proxy participant remains the current highest bidder. Once other bidders have outbid a particular participant's maximum bid amount, a display, alarm or other notification may be provided on the participant's interface to indicate that this is the case. The participant can then enter a new bid if desired. The other bidders' maximum bids will not be displayed unless they constitute the current bid. The number of participants bidding for a particular lot may be shown in the field 106.

An audio alert option 116 may also be provided on the display 60. This may be in the form a selection box that may be checked or unchecked to provide the audio alert or not. The audio alerts may be in a variety of different sounds of the same or different durations. In certain embodiments, alerts may also be repeated or continued until the user responds to the alert by executing a command to discontinue the alerted event. The alerts may only be given for selected lots or auctions that the user has selected or that are in a user's tracked lots list, as is described in more detail later on. Alerted events may include the opening of an auction session, the opening of a lot, the reopening of a lot that has been closed, resuming of a paused auction, such as during a break period, when the auction participant has been outbid, etc. Other events may also trigger the alert with different events having a different alert sound so that the user may distinguish the different alerted events. The audio alert may also be provided in conjunction with a visual display, such as a flashing icon, pop up window or icon or other visual device that may further facilitate notifying the auction participant of the occurrence of the alerted event.

In certain embodiments, an email, text, voice message or other notification may be provided to the participant separately from any provided on the remote participant interface. The notification may be generated by the auction host system and may be sent or delivered to the participant in a manner selected by the participant to indicate they have been outbid or other event has occurred or is occurring. These notifications and alerting options and preferences may be designated by the participant through the user interface.

Prior to the opening of a live auction of a particular lot, the proxy participants may be allowed to modify or even delete or cancel their proxy bids for that lot. In certain embodiments, prior to the lot opening, if the participant's bid constitutes the current bid the participant may be prevented from canceling their bid, but may cancel or delete the amount of their maximum bid exceeding the current bid. In other embodiments, provided the auction for the lot has not opened, the participant may be allowed to delete their entire bid regardless of whether it constitutes the current bid or not. In such instances, the current bid may default to a prior bid amount or other bid based on other bids that have been placed. In certain embodiments, proxy bidding may take place during pauses or breaks in a live auction for a particular lot, which may then be resumed taking into account the new proxy bids. In other embodiments, all proxy bidding may be concluded upon the opening of an auction for the lot. In still other embodiments, a proxy bid for a maximum amount exceeding the next bid amount may be entered during a live auction that is automatically updated as the current bid amount as the bidding is carried out until the maximum proxy bid amount has been reached.

In certain applications, the participant may be provided with an option for bid protection. In such cases, the remote participant selects such bid protection option through the user interface. This authorizes the auction host to increase the participant's bid by a selected bid increment (e.g. 1 or 2 bid increments) in excess of that placed by the participant if such selected increment is necessary to be the winning bidder for a particular lot.

Figure 8:
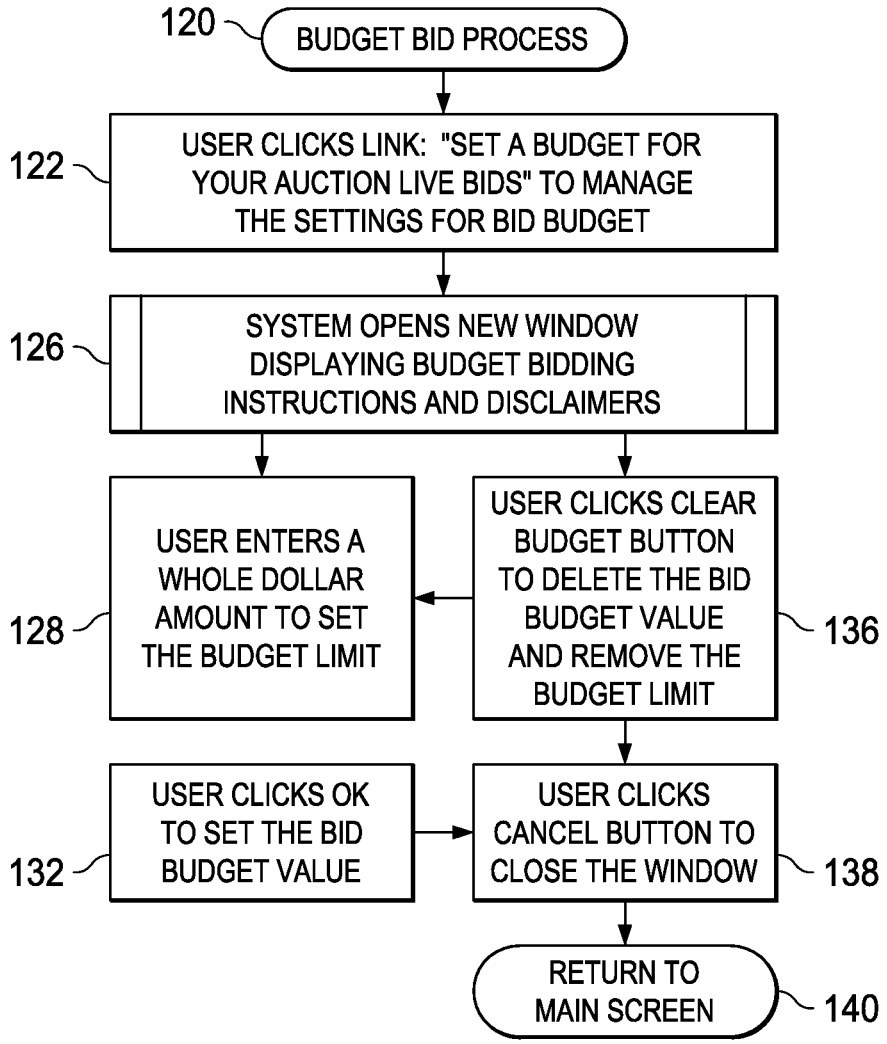
FIG. 8 is a process flow diagram showing budget bidding setup process steps that may be conducted with the auction host system.
Figure 9:
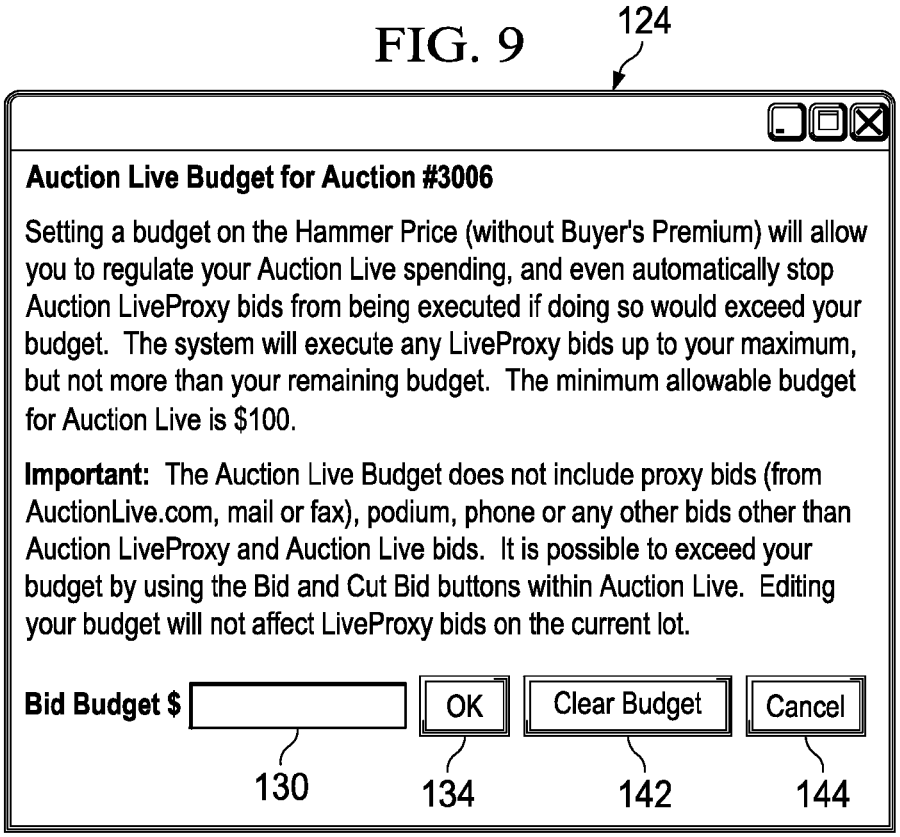
FIG. 9 is a budget bidding window of a screen display where an auction participant may enter a budget amount for budget bidding.

Another feature that may be provided in the auction system for the remote auction participants is a method for staying within a certain budget while bidding on one or more lots. FIG. 8 shows a flow diagram of a budget bidding method where the remote participant may begin a budget bid process at 120 by selecting a budget bid option at 122 that may provided on the participant interface. Once selected, a new window 124 (FIG. 9) may be opened 126 (FIG. 8) that provides instructions, disclaimers and other information regarding the budget bidding. A participant may enter at 128 a budget amount limit in a field 130 (FIG. 9) provided in the budget window 124 that they do not want to exceed. The participant confirms the budget amount by actuating at 132 (FIG. 8) a command button 134 (FIG. 9) that is sent and stored on the auction system. The participant may also clear at 136 (FIG. 8) the budget field 130 (FIG. 9) and/or cancel at 138 (FIG. 8) the budget process, which returns the participant to the main or a prior screen at 140. FIG. 9 shows the clear and cancel buttons 142, 144.

The budget bidding option may be used when the participant may want to bid on several items and set maximum proxy bids for which the total of the maximum proxy bids may exceed the amount the participant wants to spend. When implementing the budget bidding process, when the proxy bidder wins a particular lot, the amount of the winning bid is deducted from the budget bidder's remaining budgeted amount. In certain embodiments, one or more maximum proxy bids, which may be selected by the user, may also be automatically reduced to stay within the reduced budget amount. Once the budget amount has been allotted to winning bids, any remaining proxy bids are canceled.

Figure 10:
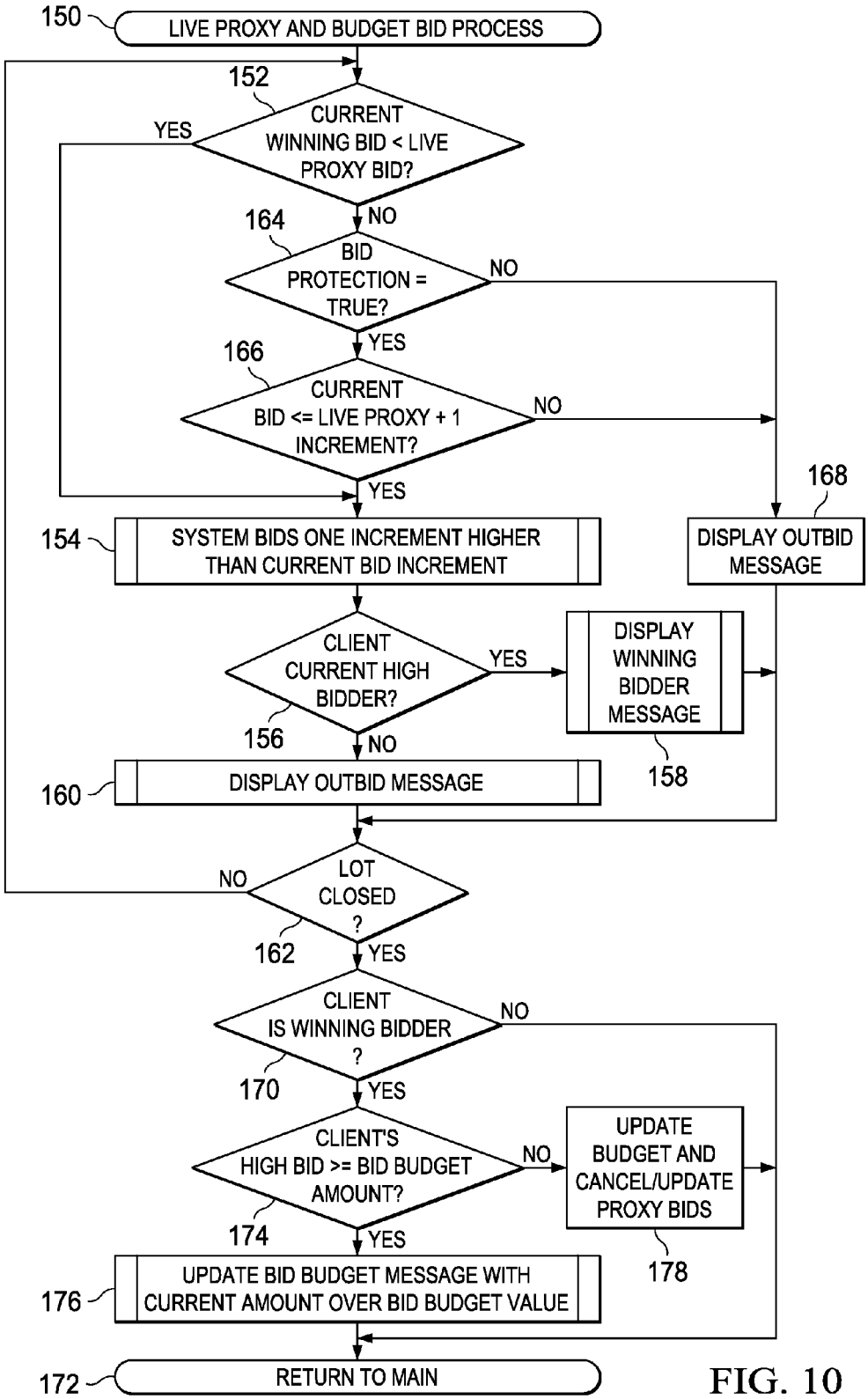
FIG. 10 is a process flow diagram showing proxy bidding and budget bidding process steps.

FIG. 10 shows a flow diagram of the method of implementing the proxy bidding, including the integration of the bid protection and budget bidding. The process is started at 150. Once a participant enters a maximum proxy bid and any optional bid protection and budget bidding options, the current bid is compared to the maximum proxy bid set at 152. If the current bid is less than the maximum proxy bid, the auction system will increase the bid by one bid increment or multiple bid increments over the current bid at 154 up to the bidders maximum bid amount. This will be compared to any other bids that exist at 156. If this increased bid is the current highest bid, a notification is provided that the participant is the current winning bidder at 158. If the participant is not the current highest bidder, a notification will be displayed that the bidding participant has been outbid at 160. During the process, the system will determine if the lot auction is open or closed at 162. If the lot has not closed, the participant may increase their maximum bid amount where the process is started at 152.

When the current bid is greater than the proxy bid amount, a determination of whether bid protection has been implemented is conducted at 164. If bid protection is implemented, a determination is then made as to whether the current bid is less than the maximum proxy bid plus the selected number of allotted bid protection bid increments (e.g. one allotted increment) at 166. The system will allow the bid to be updated with the allotted bid protection increments, as shown at 154. If the current bid is greater than the proxy bid plus the allotted bid protection increments or if no bid protection has been implemented, a notification will be displayed that the bidding participant has been outbid at 160. If the lot has not closed, the participant may increase their maximum bid amount where the process is started at 152 and implement any bid protection, if desired.

If the lot has closed, a determination is made as to whether the participant is the winner at 170. If not the winner, the participant may be returned to a main live auction screen or other area at 172, such as where bidding participation for future or other non-closed lots may be conducted.

If the participant is the winning bidder, a notification of such status may be provided. Where budget bidding has been instituted, a further determination is made as to whether the winning bid has exceeded the participant's budget limit at 174. If so, an updated budget message may be provided that the winning bid has exceeded the budget and an amount over the bid budget may be provided 176. If the budget limit has not been exceeded, the budget is updated deducting the winning bid amount and any existing proxy bids for other non-closed lots that cannot be met by the remaining budget are automatically canceled at 178. After the bidding process is complete, the participant may then be returned to a main live auction screen or other area at 172.

Figure 11:
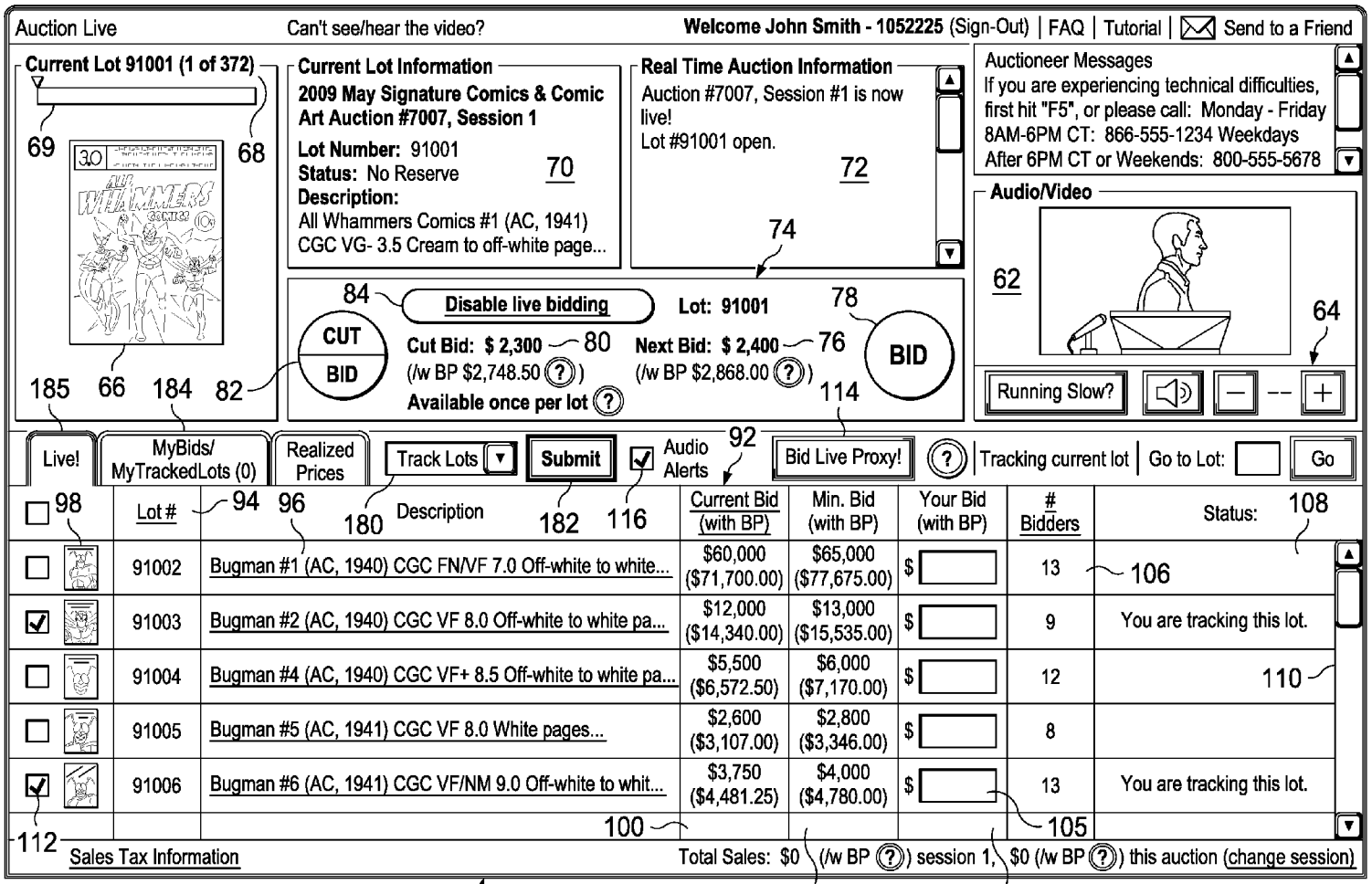
FIG. 11 is an example of a screen display of a remote auction participant interface that facilitates tracking of selected lots of an auction.
Figure 12:
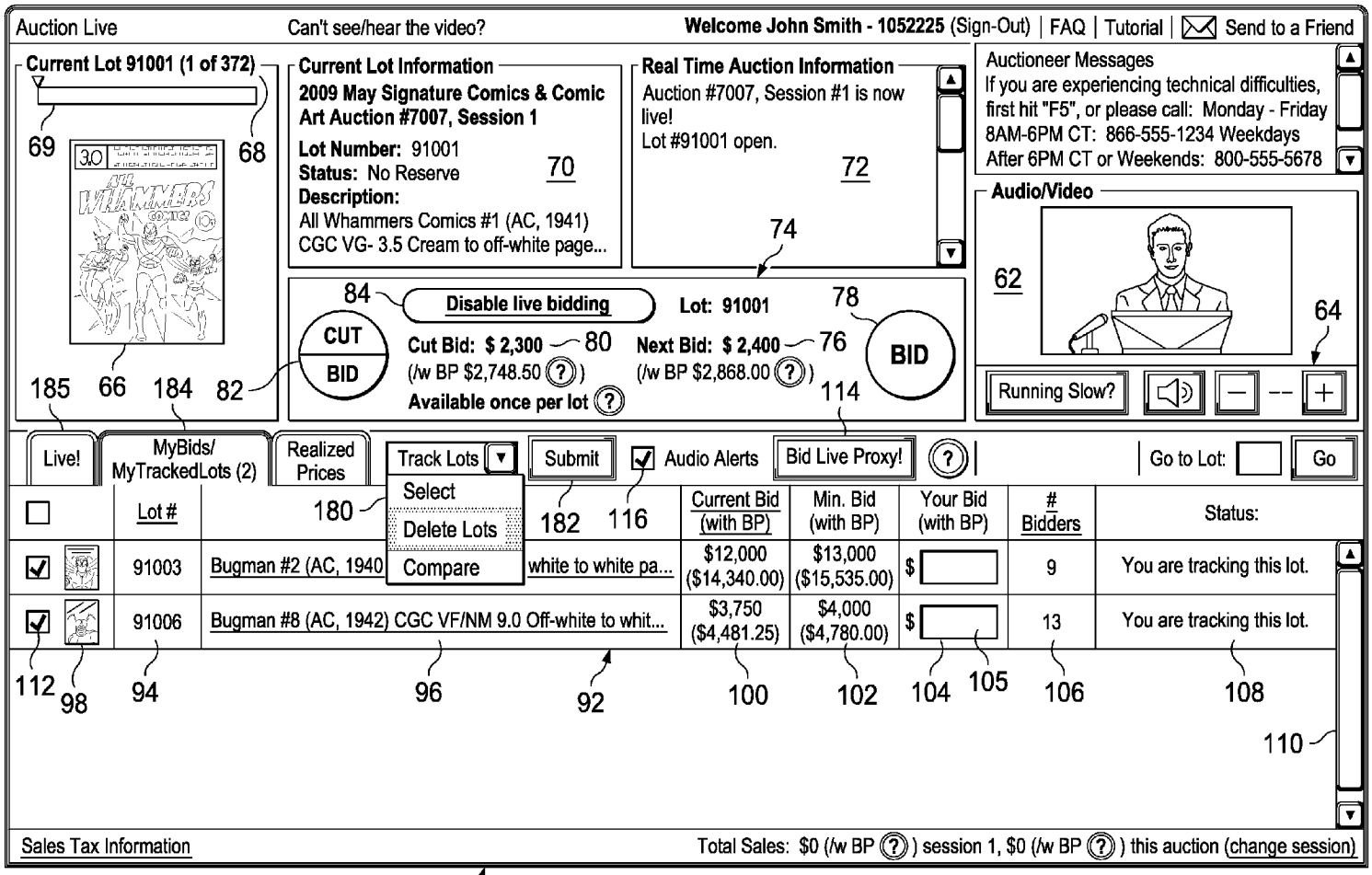
FIG. 12 is an example of a screen display of a remote participant interface showing tracked lots.

To facilitate the tracking of different lots a remote auction participant may be interested in, a lot tracking feature is provided on the remote participant interface 44. Referring to FIG. 11, the interface display 60 is shown. In the lot listing section 92 where the various lots for a particular session are displayed, a user may browse through the various lots displayed and check or mark the selection box 112 of each item to be tracked. After each item is selected, a user may access a drop down menu 180 or other selection tool and select the menu item for tracking lots. A user may then actuate a submit or other command button or device 182 that adds the selected lots to the user's tracked list. A "MyBids/MyTrackedLots" tab 184 or other link may facilitate navigating the user to a display of their tracked lots list, as shown in FIG. 12. A "live" tab 185 may facilitate return to the live lot item list. The status field 108 may also display updated status regarding the tracked lots. This may include information such as the time until the auction for the lot, that the auction for the lot is closed, a winning bidder indication, an auction paused indication, etc. Other information may also be provided in the status field 108.

Other means may also be used to add lots to the tracked lots list. If a user wants additional information about a lot, the user may click a link for the lot that will launch a webpage or window with more detailed information for the lot item. A command to add the item to the tracked lots list may be provided on the individual lot page, which will then add that lot to the user's tracked lots list. Other methods of selecting and adding tracked lots may also be employed.

In the embodiment shown in FIG. 12, items may be deleted from the tracked lots list by checking the selection box 112 and using the drop down menu 180 and highlighting the delete selected lots and actuate the submit command 182. Other means for deleting the tracked lots may also be used.

The drop down menu 180 also provides a compare option, as shown in FIG. 12. By selecting the compare option, a limited number of lots can be compared in a side by side comparison. When the submit command 182 is actuated in the compare mode, a window or web page 186 is launched, as shown in FIG. 13. Here the user can quickly see detailed information about the compared lots. This may include a lot image, a lot name, a sale number, an auction session number, a lot identifier, a category, an estimated value, a current bid amount, a next bid amount, a status (e.g. no reserve), a detailed item description, as well as other information. The user may close the window or page by executing a close command such as clicking the close icon 188, which may bring the user to a previous open screen.

It should be noted that although the remote auction participants may typically include those that may be bidding in the auctions, the participants may include auction consignors or owners of lot items that are being auctioned through the auction system. The consignors may use the lot tracking features previously described to track their own lots and see the status of their lots. In many instances, when the consignors have logged in, they may be prevented from bidding from their own lots through server validation or other means that associates the lot items with the consignor. In certain embodiments, the consignor may still participate in bidding for items that are not associated with the consignor.

Another feature of the auction system includes the ability for the auction host to process bids that may have been placed by a remote auction participant but, which due to lag times in the transmission and receiving of the bid instruction, is not received by the auction host until the bidding on a particular lot has already closed. When a lot is closed or in the process of being closed, the receipt of late bids are monitored, such as by a separate thread or program configured for monitoring the late bids. When the late bids are detected, a latency detection notification is provided by the auction host system after the closing of an auctioned lot has been completed at the host location. This may be only for bids that are received within a preselected amount of time after the bidding has been closed, such less than 1, 2, 3, 4 or 5 seconds. When a late bid received within the predetermined time limit is received, the late bid notification is triggered and this information may be provided to the auction overseer or administrator. Likewise, after the bidding on a lot has closed and the next lot has opened, late bids from the previously closed lot may be monitored and the notification may be provided. The late bids may be stored in a memory register on the auction host computer or server system, where the notification may be provided by a server push. The notified auction overseer or administrator is then allowed to reopen the closed lot for bidding wherein all auction participants may continue to bid for the reopened lot.

Figure 14:
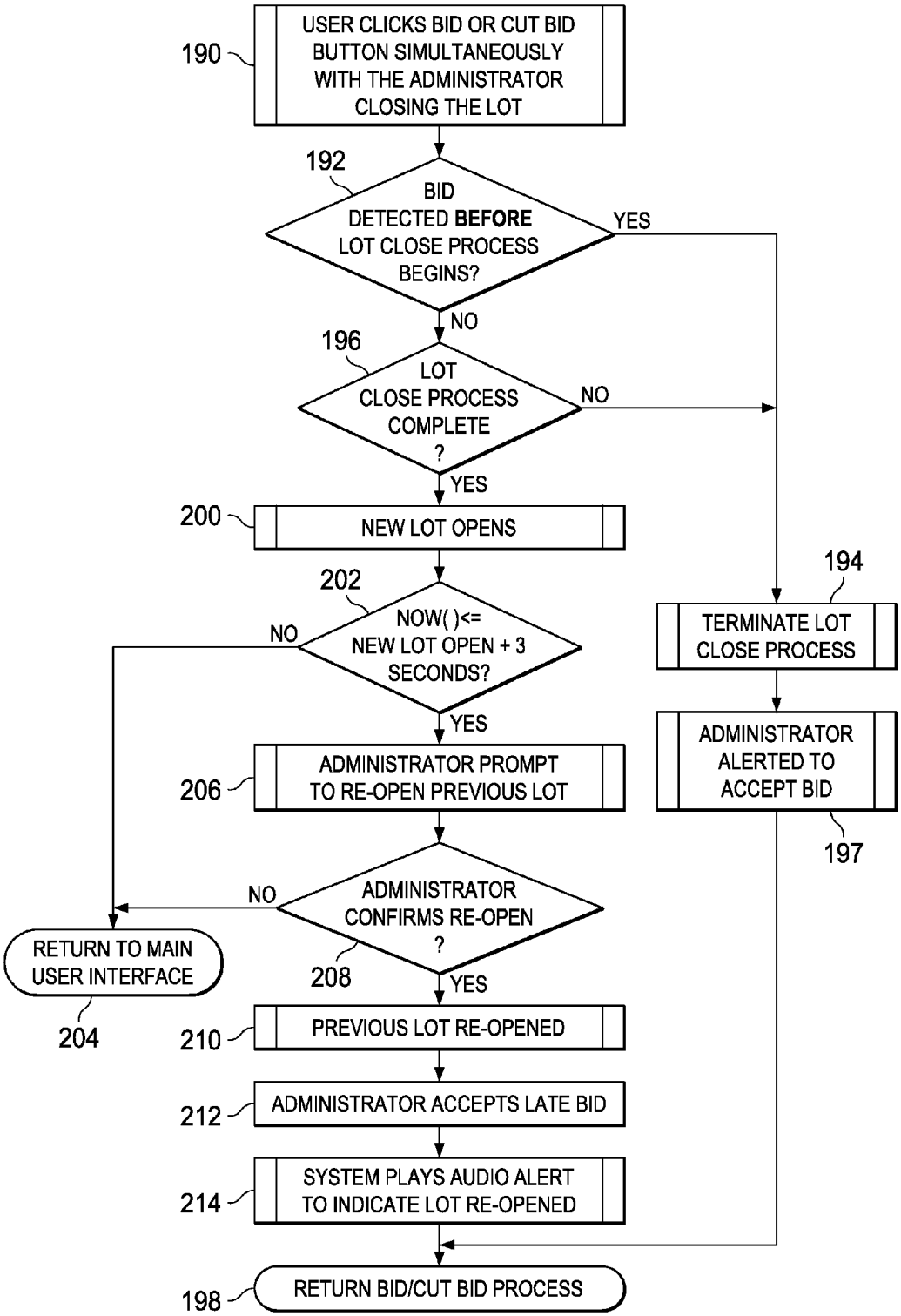
FIG. 14 is a process flow diagram showing process steps of a latent bid detection system.

FIG. 14 shows a flow diagram of the latent bid detection process. The latent bid detection process begins when a remote auction participant executes a bid by clicking the bid or cut bid button when the auction administrator is closing the live auction for a lot at 190. A determination is made as to whether a bid is received by the auction host system before the lot closing process has begun at 192. If yes, the lot closing process is terminated at 194. If the bid was not received before the lot closing process, a determination is made as to whether the lot closing process is complete at 196. If not, the lot closing process is terminated at 194. In cases where the lot closing is terminated, the bid is accepted at 197 and the bidding continues at 198.

If the lot closing process is complete an auction is opened for the next lot at 200. If a bid is now received for the closed lot, a determination is made as to whether the bid was received within the predetermined period for receiving late bids (e.g. within 3 seconds of lot closing) at 202. If the bid is not received within the predetermined period, the bid is not accepted and the user may be provided with the main user interface at 204 and wherein the bidding on the next lot continues. If the bid is received within the predetermined period, the auction administrator is prompted to re-open the previous lot at 206. A decision is made by the administrator to confirm reopening of the closed lot at 208. If the administrator does not confirm the re-opening of the lot, which may be in their discretion, the user may be provided with the main user interface at 204 wherein the bidding on the next lot may continue. If the administrator does confirm re-opening of the closed lot, any newly opened lot may be paused, and the previously closed lot re-opened at 210. The administrator accepts the late bid at 212 and the system may play an audio alert to indicate the previous lot has been re-opened at 214. The bidding on the re-opened lot is continued at 198.

Figure 15:
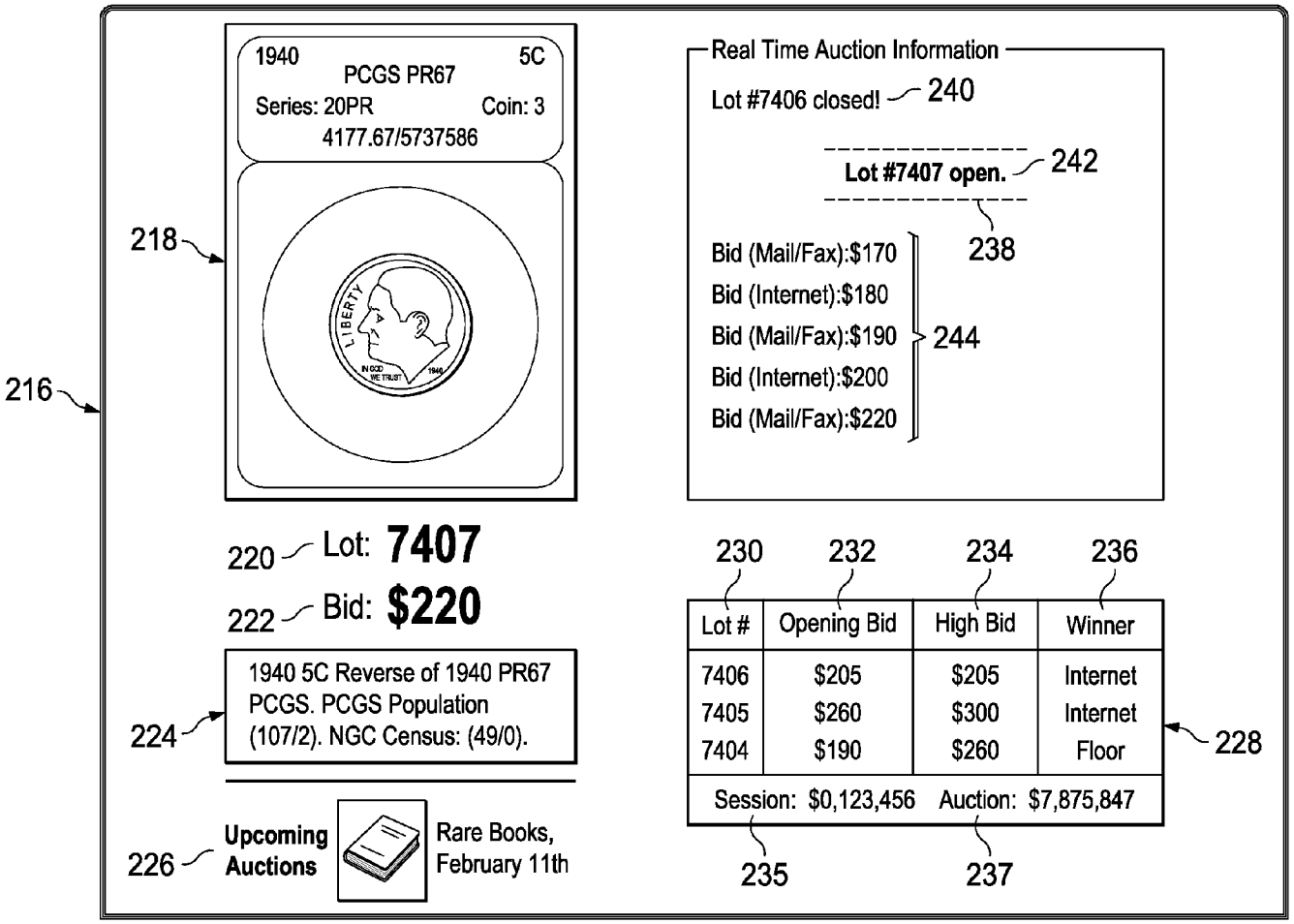
FIG. 15 is an example of an auction room display for displaying at the live auction venue.

During a live auction, updated information is provided in substantial real time to the remote auction participants at their remote interfaces 44. Those that are present in the auction room or venue 10 are also provided updated information regarding the live auction. This may be provided on the display device 30 (FIG. 1). FIG. 15 shows an example of an auction room display 216 that may be displayed with information regarding the live auction at the auction room or venue 10. The same screen may be provided on multiple display devices in the auction room or around the auction venue. As discussed previously, the screen 216 may be the same or similar to those of the auction administrators 16, 18, 20 and may be controlled by one or more of the administrators. The screen 216 is provided with substantially instantaneous or substantially real time data and results of the live auction from the auction system, which may be updated by one of the administrators 16, 18, 20, such as when receiving floor bids. In certain embodiments, the information provided may be the same or similar to that provided at the remote auction participant interface, except it may not include the lot listing section 92 or tracked lots section.

The information provided on the auction room screen 216 may include a dynamic countdown clock (not shown) indicating the amount of time until the start of an auction session or the opening of a particular lot. Other information may include a representative current lot image 218, a current lot identifier 220, a bid amount 222, which may be an opening bid amount, a current bid amount or a winning bid amount for the current lot, a lot description 224 and information about future auctions or lots 226. A summary of previous closed lots 228 may also be provided. The summary 228 may include lot identifying information 230, the opening bid amount for each lot 232, the winning bid amount 234 and the winning bid type 236 (e.g. Internet, proxy, floor, phone, mail, etc.). A session sales total 235 and an auction sales total 237 may also be displayed.

Also provided on the screen 216 is a current lot information field 238. In some embodiments, the information provided in the information field 238 may be the same or similar to that provided in the live auction field 72 of the remote auction participant screen 60. The information provided in the field 238 may include information of the previously closed lot 240 including a lot identifier and its status. A current lot identifier and its status 242 is also provided. Updated bidding statistics are also listed 244. The statistics 244 and other information may be continuously scrolled as the information is received so that only the latest information is provided. In the embodiment shown, the latest five bids are displayed along with the bid type for each. Other information may also be provided.

Because proxy bidding, as previously described, may have already occurred prior to the opening of an auction for a given lot, the information field 238 may be immediately populated with the last number of sequential bids from the proxy bidding or prebids at the opening of the auction for a particular lot. This may be displayed and populated very rapidly at the opening of the auction for each lot (e.g. 1 second or less). The listing of this prebid activity at the opening of the auction may facilitate initiating of the bidding process as other bidders can see that bids have already been received, which may serve to stimulate the live bidding process.

Figure 16:
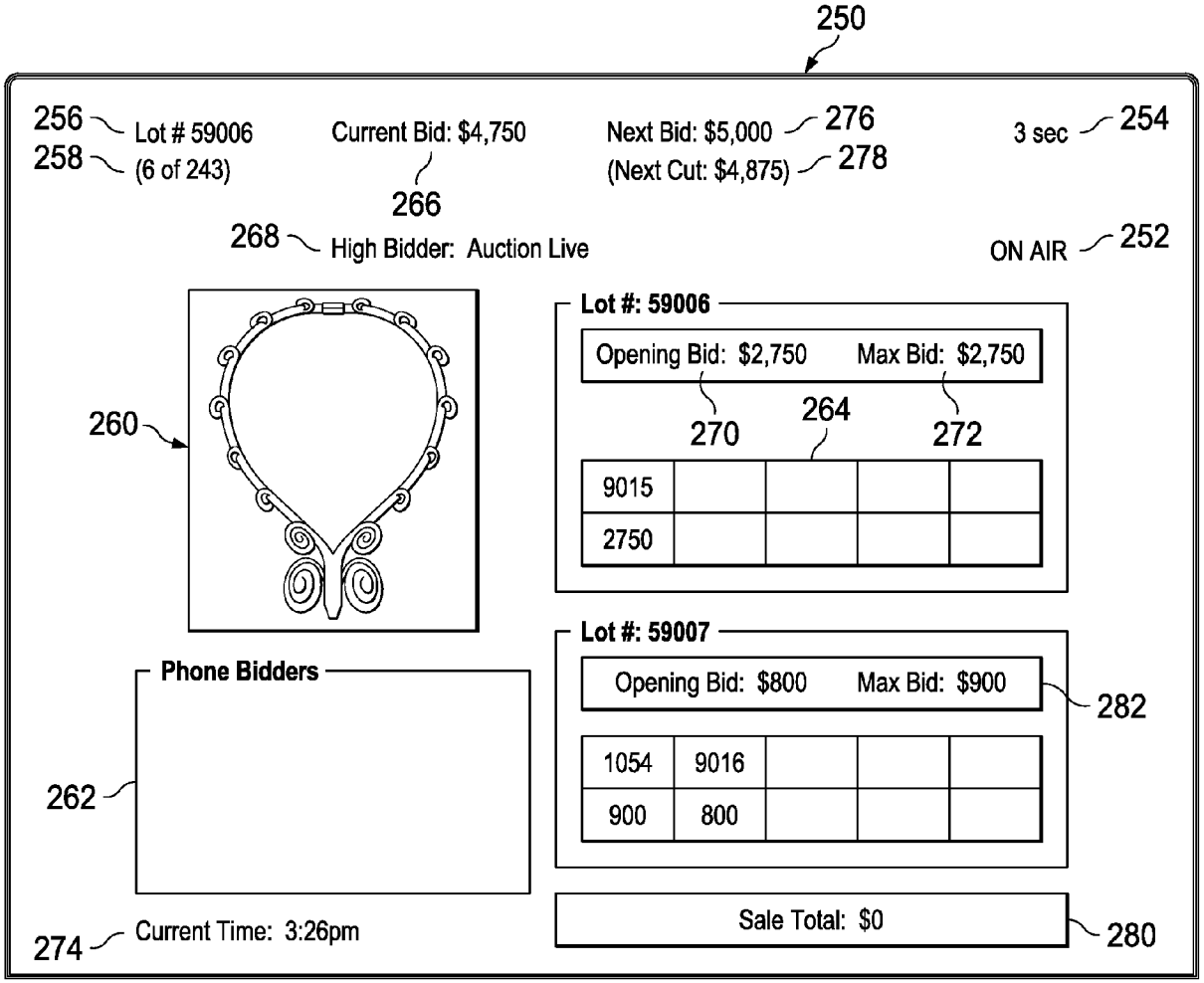
FIG. 16 is an example of an auctioneer's screen display that may be used by an auctioneer or overseer of a live auction.

Referring to FIG. 16, the auctioneer or overseer may be provided with updated auction information through an auctioneer display or screen 250 that may provided on the auctioneer's display device 26. The information provided may prompt the auctioneer for information that may have been updated just seconds prior to the lot or session open. The information may include book information, auction information and internal information that is valuable and that may be critical for the auctioneer or overseer to have readily available. In certain instances, the auctioneer screen 250 may be the same or similar to that of the administrators' at 16, 18, 20.

The auctioneer screen 250 may be provided with a variety of updated information. As non-limiting examples, this may include an on air/off air status 252, a time field 254 that may show a countdown time with the amount of time after a lot has closed to receive latent bids or that a notification that a lot has been open more than the minimum required time, an identifier for an opening auction lot or a currently auctioned lot 256, a current lot position with respect to total lots in a session 258, a lot image 260, a list of auction participants 262 that may be authorized to participate by certain methods such as phone or other means, lot bid information prior to opening of a current lot auction and current lot bid information 264, a current bid amount 266, current bidder or high bidder information 268, a recent past bid amount or opening bid amount 270, a maximum bid or highest proxy bid amount 272, a current time 274, a next bid amount 276, a next cut bid amount 278 and an auction or session sale total 280. Information 282 about the next lot may also be provided, which may include the same information for the current lot, such as opening bid amount, lot identifier, etc. Other information may include bidder information of a current bid, bidder information of a recent past bid, a written lot description, status of an auctioned lot, winning bid information of a recent auctioned lot, information regarding future auctions. The information may continuously updated and be provided substantially instantaneously or substantially in real time.

During the operation of the auction host system, information may be collected and stored on the auction host computer or servers that is received from a variety of sources and that is processed and/or stored on the auction host system. This may facilitate a response or optimization of the auction host system and processes. Thus, for example, if the host receives a number of complaints from users about a particular event or feature, the auction host can review the logged information to readily determine what event or feature most likely occurred that caused the users to complain. Every request and response between each remote user and the auction host system may be logged. Non-limiting examples of information that may be collected include user or remote auction participant identifiers, the time a remote auction participant's information was received, the time elapsed for completion of a response transmitted to the remote auction participant's received information, a browser type of each remote auction participant's user station, the identification of an operating system of each user participant's remote participant interface, queue information and information regarding the one or more auctioned lots, such as bid information, high bidder notifications, etc. The collected information may facilitate the identification of issues, such as problems with a particular browser type or at a particular time when there may have been a transmission failure, etc.

In many applications, data and information may be pre-cached in a queue of the auction host system so that the remote participant has no delaying in accessing and navigating through the queue data. In some auctions, an auction session may have two thousand lots or more, which requires a large amount of information to be stored and made readily available. In pre-caching the queue data for the various lots in memory, the information can be readily retrieved with little if any delay.

Additionally, lots may be organized in lot grids. This may be done using several technologies that are integrated together (e.g. ajax, Zend cache, memcache, server push technology, etc.). These may be used to create a grid that dynamically loads upcoming lot information and realized prices, which allows for a very small load time for large amounts of data. The grid data may be cached on both the remote participant's system and/or on the auction host system to ensure that the remote participant only downloads the minimum amount of data when navigating the lot grid.

In certain embodiments, in addition to the audio/video feeds, a live chat feature may be provided for providing instant communication between the auction host administrators or personnel and the remote participants. This may be communications to all the remote participants or only those selected by the auction host. The remote participant may also initiate the chat communications. In certain applications, the live chat is conducted between the auctioneer or overseer and the remote participants. The auctioneer may control and conduct the on-line chat, sending messages as desired to the remote participants regarding the auction, auction session or a particular lot or lots. The chat messages may be time stamped and logged on the auction host system.

The auction participants can participate in a live auction in a number of ways. The auction host and/or auction host system may track the bidding to prevent participants from bidding against themselves. Using the auction system, the auction administrator is able to keep track of the different bids and communicate to clients in substantially real time what bid source is the current highest bidder, as has been previously described. The participants may participate and bid through the remote participant interface, by phone communication, by facsimile transmission, by floor or in-person notification at the host location, by third-party proxy notification at the host location, by email or electronic communications other than through the remote participant interface and by mail or other physical courier.

In certain embodiments, a live auction audio feed backup system may be implemented. This may be used in cases where auctions are conducted at remote locations away from a main host location or remote from the auction host computer or server system where there is no local area network or other private network. In such cases, the remote live auction video and audio streams may be transmitted through an available Internet network connection. The live auction audio backup system, however, may be used where there is no Internet connection whatsoever, or where the Internet connection fails or where there is insufficient bandwidth to broadcast the video and/or audio stream.

Figure 17:
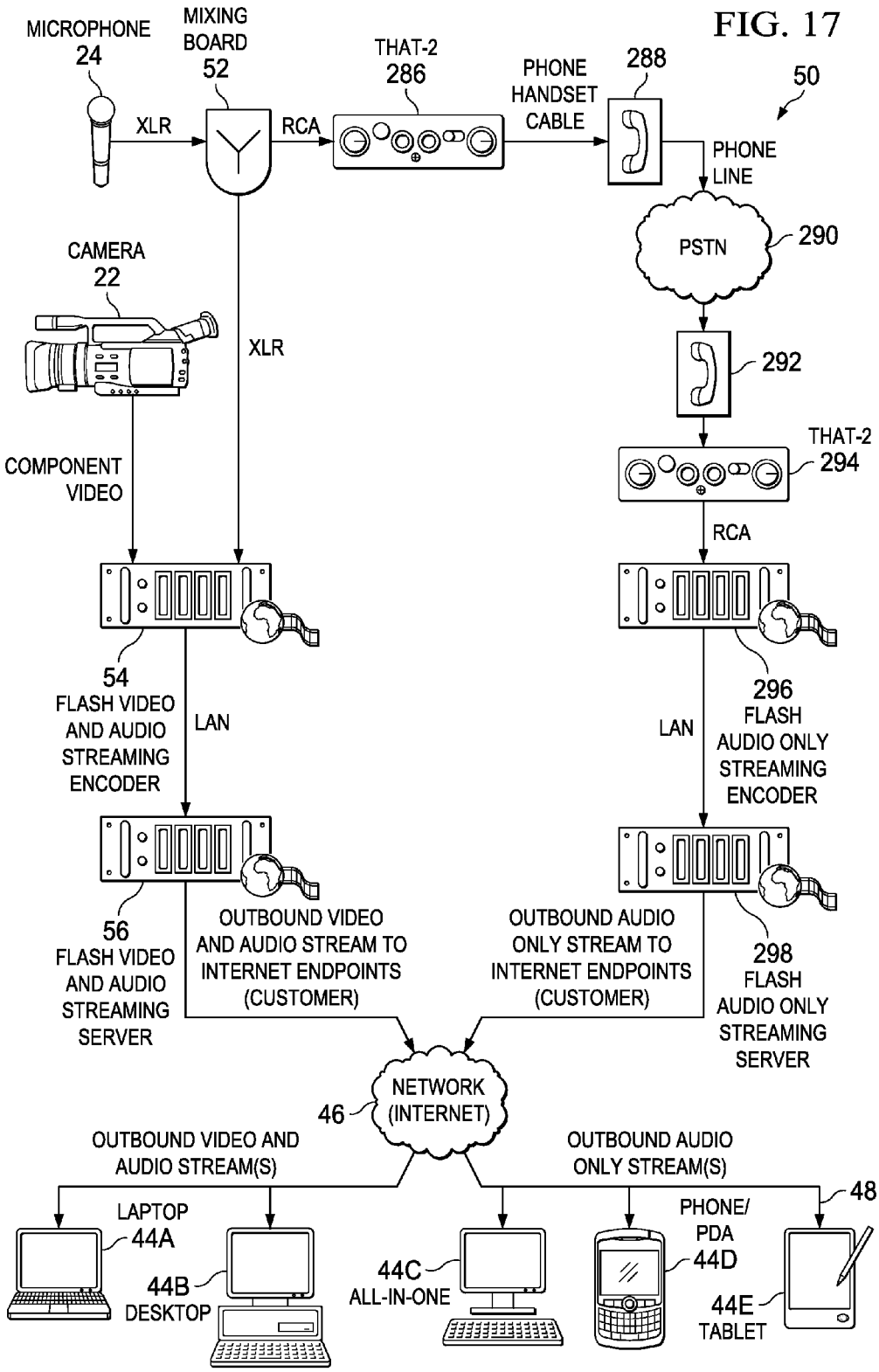
FIG. 17 is a schematic representation of the live auction system of FIG. 2, shown with an audio feed backup system.

Referring to FIG. 17, an audio backup system is shown implemented with the video and audio streaming system 50 of FIG. 3, with similar components labeled with the same reference numerals. The audio backup system makes use of a split audio and video feed that allows a live stream to be provided with only the audio feed of the auction. This may resolve the issue of limited bandwidth in outlying areas and other similar situations. As can be seen an additional audio output is provided from the sound mixing board 52 and may be converted from an analog audio (e.g. RCA, XLR) signal to an analog telephone output through a telephone audio device 286, such as a THAT-2, with a telephone handset connection (e.g. RJ-22). A phone 288 is connected to the telephone audio device 286 through a telephone network 290, such as public switch telephone network (PSTN), where a telephone connection is made to the main auction host location where the auction host computer or server system is located. This may be done by dialing a special number at the phone 288 for the main auction facility, which is connected to a phone 292 at the main auction host location. The phone 292 may be a network of phones that each have unique dial-up numbers and an auto-answer feature so that the phone 292 is automatically answered. In this way, if there multiple auctions occurring simultaneously they can each be automatically connected. The phone 292 is also connected to telephone audio device 294 (e.g. That-2) for converting the analog telephone input (e.g. RJ-22) to an audio analog output (e.g. RCA, XLR). The signal from the audio converter 294 is sent to encoder 296 (e.g. Flash encoder), which may be an audio-only encoder and which may be dedicated solely for receiving such signals. The encoder 296 converts the received audio signals to a streaming audio file. The encoder 296 may send a separate audio-only signal to a streaming audio server 298, which may be an audio-only server of the host auction system. This is then transmitted to the main communication network 46 (e.g. Internet) and to the remote auction participants 44, where the remote auction participants are provided with a substantially real time audio feed of the live auction. Thus, a substantially real time audio feed may be provided even in situations where the remote auction may have no broadband network connection.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

We claim:

1. A method of conducting a live auction using a computer-readable medium having computer useable executable instructions thereon to perform the method, said method comprising:

providing access for auction participants to an auction for one or more auctioned lots of products or services that is conducted and overseen by an auction administrator at an auction host location, at least some of the access to the live auction being provided to remote auction participants through an auction host computer system that is in electronic communication with the remote auction participants over a computer communications network, each of said remote auction participants having a remote participant interface embodied on a remote computer device configured for electronic communication with the auction host computer system;

detecting with the auction host computer system at least one remote participant interface configuration of a remote auction participant and adjusting data transmission to said remote auction participant based upon the detected configuration;

transmitting substantially in real time from the auction host computer system auction-related data and at least one of video and audio feeds of the live auction through the computer communications network to the remote computer systems of one or more remote auction participants by way of said remote participant interface;

receiving information from the remote computer systems of the remote auction participants through the remote participant interface transmitted to the auction host computer system;

initiating a test bid upon a remote auction participant initially accessing information through the network provided from the auction host computer system, the test bid mimicking a bid request that is transmitted to the auction host computer system over the network to evaluate whether information from the remote auction participant is being properly received by the auction host computer system through the network, the remote auction participant being provided at the remote participant interface with an indication of at least one of a success or failure as to whether information transmitted from the remote computer systems over the communications network is being properly received by the auction host commuter system;

displaying on an auction display of the auction host computer system at the auction host location information regarding the conducted auction and current bid information;

receiving at least one bid for a lot of products or services from a remote auction participant transmitted over the communications network to the auction host computer system;

displaying, by said auction host computer system, the bid amount to remote auction participants and/or live auction participants;

electronically notifying the remote auction participant over the communications network of a winning bid or withdrawal of the auctioned lot if the bid amount is not at or above predetermined minimum bid amount; and closing the auction for the auctioned lot.

2. The method as set forth in claim 1, further comprising the step of displaying to auction participants at the opening of an auctioned lot a selected number of prebids that have been placed by auction participants prior to opening of an auctioned lot.

3. The method as set forth in claim 2, further comprising the step of selecting, by the remote auction participant, information for two or more lots and displaying, by the remote participant interface, the two or more lots in close proximity to one another on a display of the remote participant interface to facilitate comparison of the two or more lots.

4. The method as set forth in claim 1, further comprising the step of receiving additional bids from other remote auction participants, each new bid raising the bid amount by a preselected incremental amount assigned for the auctioned lot.

5. The method as set forth in claim 4, further comprising the step of providing each remote auction participant with a limited number of cut bids for at least one auctioned lot that allows the remote auction participant to place a cut bid in an amount that is less than the preselected incremental full bid amount assigned for each auctioned lot.

6. The method as set forth in claim 5, further comprising the step preventing the remote auction participant from placing further cut bids when the limited number of cut bids has been placed.

7. The method as set forth in claim 1, further comprising the step of providing the remote participant interface with a bid disablement feature that is selected to disable bidding commands.

8. The method as set forth in claim 1, further comprising the steps of:

setting, by the remote auction participant, a maximum bid amount the remote auction participant is willing to pay; and providing the remote auction participant with a selectable bid protection option on the remote participant interface that allows the auction host to increase the bid of a remote auction participant by a selected bid increment above the maximum bid amount if the selected bid increment is necessary for a winning bid.

9. The method as set forth in claim 1, further comprising the steps of providing an audio alert at a remote participant interface to prompt the remote auction participant regarding the occurrence of an event and providing a live chat feature to allow communication between auction host administrators or personnel and the remote participants.

10. The method of claim 1, wherein the information received by the auction host computer system includes a proxy bid amount for at least one selected lot received from at least one remote auction participant through the remote participant interface, the proxy bid amount being a maximum bid amount of the at least one remote auction participant for the at least one selected lot, the proxy bid amount being compared to other bids received for the at least one selected lot by the live auction system prior to or during the auction of the at least one lot; and providing the remote auction participant with a selectable bid protection option on the remote participant interface that allows the auction host to increase the bid of a remote auction participant by a selected bid increment above the maximum bid amount if the selected bid increment is necessary for a winning bid.

11. The method of claim 1, wherein the information received by the auction host computer system includes a budget bid amount for at least two selected lots received from at least one remote auction participant through the remote participant interface, an amount spent on a successful bid for a first of said selected lots being deducted from the budget bid amount so that the remote auction participant is limited to a remaining balance of the budget bid amount when bidding on a second of said selected lots.

12. A method of conducting a live electronic auction comprising the computer-implemented steps of:

providing access for auction participants to an auction for one or more auctioned lots of products or services that is conducted and overseen by an auction administrator at an auction host location, at least some of the access to the live auction being provided to remote auction participants through an auction host computer system over a computer communications network;

detecting with the auction host computer system at least one remote participant interface configuration of a computer device of a remote auction participant and adjusting data transmission to said remote auction participant based upon the detected interface configuration;

transmitting substantially in real time from the auction host computer system auction-related data and at least one of video and audio feeds of the live auction through the computer communications network to at least said one remote auction participant in accordance with said remote participant interface configuration of said remote participant computer device;

receiving information from the remote auction participants through the remote participant interface transmitted over the computer communications network to the auction host computer system;

receiving, by the auction host computer system, at least one bid for a lot of products or services from a remote auction participant;

displaying the bid amount to remote auction, participants and/or live auction participants;

displaying on an auction display of the auction host computer system at the auction host location information regarding the conducted auction and current bid information;

receiving additional new bids from other remote auction participants, said bids being electronically transmitted from the computer devices of said remote auction participants over the communications network to said auction host computer system, each new bid raising the bid amount by a preselected incremental amount assigned for the auctioned lot;

providing each remote auction participant with a limited number of cut bids for at least one auctioned lot that allows the remote auction participant to place a cut bid in an amount that is less than the preselected incremental full bid amount assigned for each auctioned lot;

preventing the remote auction participant from placing further cut bids when the limited number of cut bids has been placed;

notifying the remote auction participant over the communications network of a winning bid or withdrawal of the auctioned lot if the bid amount is not at or above a predetermined minimum bid amount; and closing the auction for the auctioned lot.

13. The method as set forth in claim 12, further comprising the step of providing a latency detection notification that facilitates the receiving of a late bid that is received by the auction host computer system after the closing of an auctioned lot at the host location, the latency detection notification facilitating the reopening and acceptance of the received late bid.

14. The method as set forth in claim 12, further comprising the step of providing the remote participant interface with a bid disablement feature that is selected to disable bidding commands.

15. The method as set forth in claim 12, further comprising the steps of:

setting, by the remote auction participant, a maximum bid amount the remote auction participant is willing to pay; and providing the remote auction participant with a selectable bid protection option on the remote participant interface that allows the auction host to increase the bid of a remote auction participant by a selected bid increment above the maximum bid amount if the selected bid increment is necessary for a winning bid.

16. The method of claim 12, wherein the information received by the auction host computer system includes a budget bid amount for at least two selected lots received from at least one remote auction participant through the remote participant interface, an amount spent on a successful bid for a first of said selected lots being deducted from the budget bid amount so that the remote auction participant is limited to a remaining balance of the budget bid amount when bidding on a second of said selected lots.

17. A method of conducting a live auction comprising the computer-implemented steps of:

providing access for auction participants to an auction for one or more auctioned lots of products or services that is conducted and overseen an auction administrator at an auction host location, at least some of the access to the live auction being provided to remotely located computer device of remote auction participants through an auction host computer system over a computer communications network;

transmitting substantially in real time from the auction host computer system auction-related data and at least one of video and audio feeds of the live auction through the computer communications network to one or more remote auction participants by way of a remote participant interface on said remotely located computer devices;

detecting with the auction host computer system at least one remote participant interface configuration of a computer device of a remote auction participant and adjusting data transmission to said at least one remote auction participant based upon the detected configuration of said computer device;

receiving information from the remote auction participants through the remote participant interface transmitted over the computer communications network to the auction host computer system;

initiating a test bid upon a remote auction participant initially accessing information through the network provided from the auction host computer system, the test bid mimicking a bid request that is transmitted to the auction host computer system over the communications network to evaluate whether information from the remote auction participant is being properly received by the auction host computer system through the network, the remote auction participant being provided at the remote participant interface with an indication of at least one of a success or failure as to whether information is being properly received by the auction host computer system;

displaying on an auction display of the auction host computer system at the auction host location information regarding the conducted auction and current bid information;

receiving at least one bid for a lot of products or services from a remote auction participant over the communications network;

displaying the bid amount to remote auction participants and/or live auction participants;

electronically notifying the remote auction participant of a winning bid or withdrawal of the auctioned lot if the hid amount is not at or above a predetermined minimum bid amount; and closing the auction for the auctioned lot.

18. The method as set forth in claim 17, further comprising the step of providing a latency detection notification that facilitates the receiving of a late bid that is received by the auction host computer system after the closing of an auctioned lot at the host location, the latency detection notification facilitating the reopening and acceptance of the received late bid.

19. The method of claim 17, wherein the information received by the auction host computer system includes a budget bid amount for at least two selected lots received from at least one remote auction participant through the remote participant interface, an amount spent on a successful bid for a first of said selected lots being deducted from the budget bid amount so that the remote auction participant is limited to a remaining balance of the budget bid amount when bidding on a second of said selected lots.

20. The method as set forth in claim 17, further comprising the steps of:

setting, by the remote auction participant, a maximum bid amount the remote auction participant is willing to pay; and providing the remote auction participant with a selectable bid protection option on the remote participant interface that allows the auction host to increase the bid of a remote auction participant by a selected bid increment above the maximum bid amount if the selected bid increment is necessary for a winning bid.

21. A non-transitory computer-readable medium having computer-useable executable instructions embodied thereon for performing a method of conducting an auction comprising:

providing access for auction participants at remote locations to an auction for one or more auctioned lots of products or services through an auction host computer system over a computer communications network;

detecting with the auction host computer system at least one remote participant interface configuration of a computer device of a remote auction participant and adjusting data transmission to said remote auction participant based upon the detected configuration of said computer device;

transmitting substantially in real time from the auction host computer system, auction-related data by way said remote participant interface of said computer device;

receiving information from remote auction participants through the remote participant interface transmitted to the auction host computer system;

receiving at least one bid for a lot of products or services from a remote auction participant, said at least one bid raising the bid amount by a preselected incremental amount assigned for the auctioned lot;

displaying the bid amount to all of the remote auction participants;

providing each remote auction participant with a limited number of cut bids for at least one auctioned lot that allows the remote auction participant to place a cut bid in an amount that is less than the preselected incremental full bid amount assigned for each auctioned lot;

preventing the remote auction participant from placing further cut bids when the limited number of cut bids has been placed;

notifying the remote auction participant of a winning bid or withdrawal of the auctioned lot if the bid amount is not at or above a predetermined minimum bid amount; and closing the auction for the auctioned lot.

22. The computer-readable medium of claim 21, wherein the information received by the auction host computer system includes a budget bid amount for at least two selected lots received from at least one remote auction participant through the remote participant interface, an amount spent on a successful bid for a first of said selected lots being deducted from the budget bid amount so that the remote auction participant is limited to a remaining balance of the budget bid amount when bidding on a second of said selected lots.

23. The computer-readable medium of claim 21, wherein, the method performed by said computer-readable medium further includes providing access for live auction participants at an auction host location that is conducted and overseen by an auction administrator, at least some of the access to the live auction being provided to remote auction participants through an auction host computer system over a computer communications network;

receiving information from the remote auction participants through the remote participant interface transmitted to the auction host computer system; and displaying on an auction display of the auction host computer system at the auction host location information regarding the conducted auction and current hid information including bids from remote participants.

24. A method of conducting a live auction using a computer-readable medium having computer-useable executable instructions embodied thereon, said method comprising the computer-implemented steps of:

providing access for auction participants to an auction for one or more auctioned lots of products or services that is conducted and overseen by an auction administrator at an auction host location, at least some of the access to the live auction being provided to remote auction participants through an auction host computer system over a computer communications network;

detecting with the auction host computer system at least one remote participant interface configuration of a computer device of a remote auction participant and adjusting data transmission to said remote auction participant based upon the detected configuration of said computer device;

transmitting substantially in real time from the auction host computer system auction-related data and at least one of video and audio feeds of the live auction through the computer communications network to at least said one remote auction participant in accordance with said remote participant interface configuration of said remote auction participant computer device;

receiving information from the remote auction participants through the remote participant interface transmitted to the auction host computer system, the information received by the auction host computer system including a proxy bid amount for at least one selected lot received from at least one remote auction participant through the remote participant interface, the proxy bid amount being a maximum bid amount of the at least one remote auction participant for the at least one selected lot, the proxy bid amount being compared to other bids received for the at least one selected lot by the live auction system prior to or during the auction of the at least one lot;

providing the remote auction participant with a selectable bid protection option on the remote participant interface that allows the auction host to increase the bid of a remote auction participant by a selected bid increment above the maximum bid amount if the selected bid increment is necessary for a winning bid;

displaying on an auction display of the auction host computer system at the auction host location information regarding the conducted auction and current bid information;

receiving at least one bid for a lot of products or services from a remote auction participant over the communications network;

displaying the bid amount to remote auction participants and/or live auction participants;

notifying the remote auction participant of a winning bid or withdrawal of the auctioned lot if the bid amount is not at or above a predetermined minimum bid amount; and closing the auction for the auctioned lot.

25. A non-transitory computer-readable medium having computer-useable executable instructions embodied thereon performing a method of conducting a live auction comprising:

providing access for auction participants to an auction for one or more auctioned lots of products or services that is conducted and overseen by an auction administrator at an auction host location, at least some of the access to the live auction being provided to remote auction participants through an auction host computer system over a computer communications network;

detecting with the auction host computer system at least one remote participant interface configuration of a computer device of a remote auction participant end adjusting data transmission to said remote auction participant based upon the detected configuration of said computer device;

transmitting substantially in real time from the auction host computer system auction-related data and at least one of video and audio feeds of the live auction through the computer communications network to at least said one remote auction participant in accordance with said interface configuration of said remote auction participant computer device;

receiving information from the remote auction participants through the remote participant interface transmitted to the auction host computer system;

receiving at least one bid for a lot of products or services from a remote auction participant;

setting, by the remote auction participant, a maximum bid amount the remote auction participant is willing to pay;

providing the remote auction participant with a selectable bid protection option on the remote participant interface that allows the auction host to increase the bid of a remote auction participant by a selected bid increment above the maximum bid amount if the selected bid increment is necessary for a winning bid;

displaying the bid amount to remote auction participants and/or live auction participants;

displaying on an auction display of the auction host computer system at the auction host location information regarding the conducted auction and current bid information;

receiving additional new bids from other remote auction participants;

notifying the remote auction participant of a winning bid or withdrawal of the auctioned lot if the bid amount is not at or above a predetermined minimum bid amount; and closing the auction for the auctioned lot.

* * * * *